US011788702B2

(12) United States Patent
Suwa et al.

(10) Patent No.: US 11,788,702 B2
(45) Date of Patent: Oct. 17, 2023

(54) HEADLIGHT MODULE AND HEADLIGHT DEVICE

(71) Applicant: Mitsubishi Electric Corporation, Tokyo (JP)

(72) Inventors: Masashige Suwa, Tokyo (JP); Ritsuya Oshima, Tokyo (JP); Muneharu Kuwata, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 116 days.

(21) Appl. No.: 17/633,213

(22) PCT Filed: Aug. 30, 2019

(86) PCT No.: PCT/JP2019/034232

§ 371 (c)(1),
(2) Date: Feb. 7, 2022

(87) PCT Pub. No.: WO2021/038855

PCT Pub. Date: Mar. 4, 2021

(65) Prior Publication Data

US 2022/0299183 A1 Sep. 22, 2022

(51) Int. Cl.
*F21S 41/265* (2018.01)
*F21S 41/663* (2018.01)
(Continued)

(52) U.S. Cl.
CPC ..... *F21S 41/265* (2018.01); *F21S 41/143* (2018.01); *F21S 41/147* (2018.01); *F21S 41/27* (2018.01); *F21S 41/663* (2018.01)

(58) Field of Classification Search
CPC ..... F21S 41/25; F21S 41/255; F21S 41/26; F21S 41/265; F21S 41/27; F21S 41/322;
(Continued)

(56) References Cited

U.S. PATENT DOCUMENTS 10,352,523 B2 * 7/2019 Nishimura ..... F21S 41/40
2017/0198877 A1 * 7/2017 Suwa ..... B60Q 1/076

FOREIGN PATENT DOCUMENTS

JP 2006-79877 A 3/2006
JP 2010-108639 A 5/2010
(Continued)

OTHER PUBLICATIONS

International Search Report and Written Opinion dated Nov. 19, 2019, received for PCT Application PCT/JP2019/034232, Filed on Aug. 30, 2019, 6 pages including English Translation.

*Primary Examiner* — Matthew J. Peerce
(74) *Attorney, Agent, or Firm* — XSENSUS LLP

(57) ABSTRACT

A headlight module includes a first light source that emits first light, and a first optical unit. The first optical unit includes a first optical surface that reflects the first light, and a lens surface that projects illuminating light including the first light reflected by the first optical surface. An edge part of the first optical surface close to the lens surface includes a first edge part and a second edge part differing from each other in a position in a direction orthogonal to an optical axis of the lens surface, and a position of the second edge part in a direction of the optical axis is closer to the lens surface than a position of the first edge part in the direction of the optical axis.

18 Claims, 18 Drawing Sheets

(51) Int. Cl.
*F21S 41/147* (2018.01)
*F21S 41/27* (2018.01)
*F21S 41/143* (2018.01)

(58) Field of Classification Search
CPC ..... F21S 41/323; F21S 41/331; F21S 41/332; F21S 41/333
See application file for complete search history.

(56) References Cited

FOREIGN PATENT DOCUMENTS

| | | | |
|---|---|---|---|
| JP | 2013-242996 | A | 12/2013 |
| JP | 2014-107049 | A | 6/2014 |
| JP | 2015-176745 | A | 10/2015 |
| WO | 2016/006138 | A1 | 1/2016 |

* cited by examiner

HEADLIGHT MODULE AND HEADLIGHT DEVICE

CROSS-REFERENCE TO RELATED APPLICATION

The present application is based on PCT filing PCT/JP2019/034232, filed Aug. 30, 2019, the entire contents of which are incorporated herein by reference.

TECHNICAL FIELD

The present invention relates to a headlight module and a headlight device.

BACKGROUND ART

A headlight device for a vehicle has been proposed in Patent Reference 1. This headlight device includes a first optical system for emitting light for a low beam, a second optical system for emitting light for a high beam, a light guide member, and a projection lens for projecting light emerging from the light guide member. A lower surface of the light guide member includes an upper-side surface at a high position in a height direction, a lower-side surface at a low position in the height direction, and an inclined surface connecting the upper-side surface and the lower-side surface together. Further, the lower surface of the light guide member is provided with a lightproof thin film. The lower surface of the light guide member and the lightproof thin film form a cutoff line of a light, distribution pattern of the light projected from the first optical system via the light guide member and the projection lens.

PRIOR ART REFERENCE

Patent Reference

Patent Reference 1: Japanese Patent Application Publication No. 2013-242996 (claims 1 to 3, paragraph 0026, FIG. 1, and FIGS. 3 to 5, for example)

SUMMARY OF THE INVENTION

Problem to be Solved by the Invention

However, light reflected by the inclined surface of the above-described headlight device travels in a direction different from the direction of light reflected by parts of the lower surface of the light guide member other than the inclined surface (i.e., the upper-side surface and the lower-side surface). Accordingly, there is a problem in that light distribution irregularity occurs to the light projected by the headlight device due to the light reflected by the inclined surface.

An object of the present invention, which has been made to resolve the above-described problem with the conventional technology, is to provide a headlight module and a headlight device capable of reducing the light distribution irregularity.

Means for Solving the Problem

A headlight module according to an aspect of the present invention includes a first light source that emits first light and a first optical unit. The first optical unit includes a first optical surface that reflects the first light and a lens surface that projects illuminating light including the first light reflected by the first optical surface. An edge part of the first optical surface close to the lens surface includes a first edge part and a second edge part differing from each other in a position in a direction orthogonal to an optical axis of the lens surface, and a position of the second edge part in a direction of the optical axis is closer to the lens surface than a position of the first edge part in the direction of the optical axis.

A headlight device according to another aspect of the present invention includes one or more modules, wherein each of the one or more modules is the above-described headlight module.

Effects of the Invention

According to the present invention, the light distribution irregularity can be reduced.

MODE FOR CARRYING OUT THE INVENTION

Figure 1:
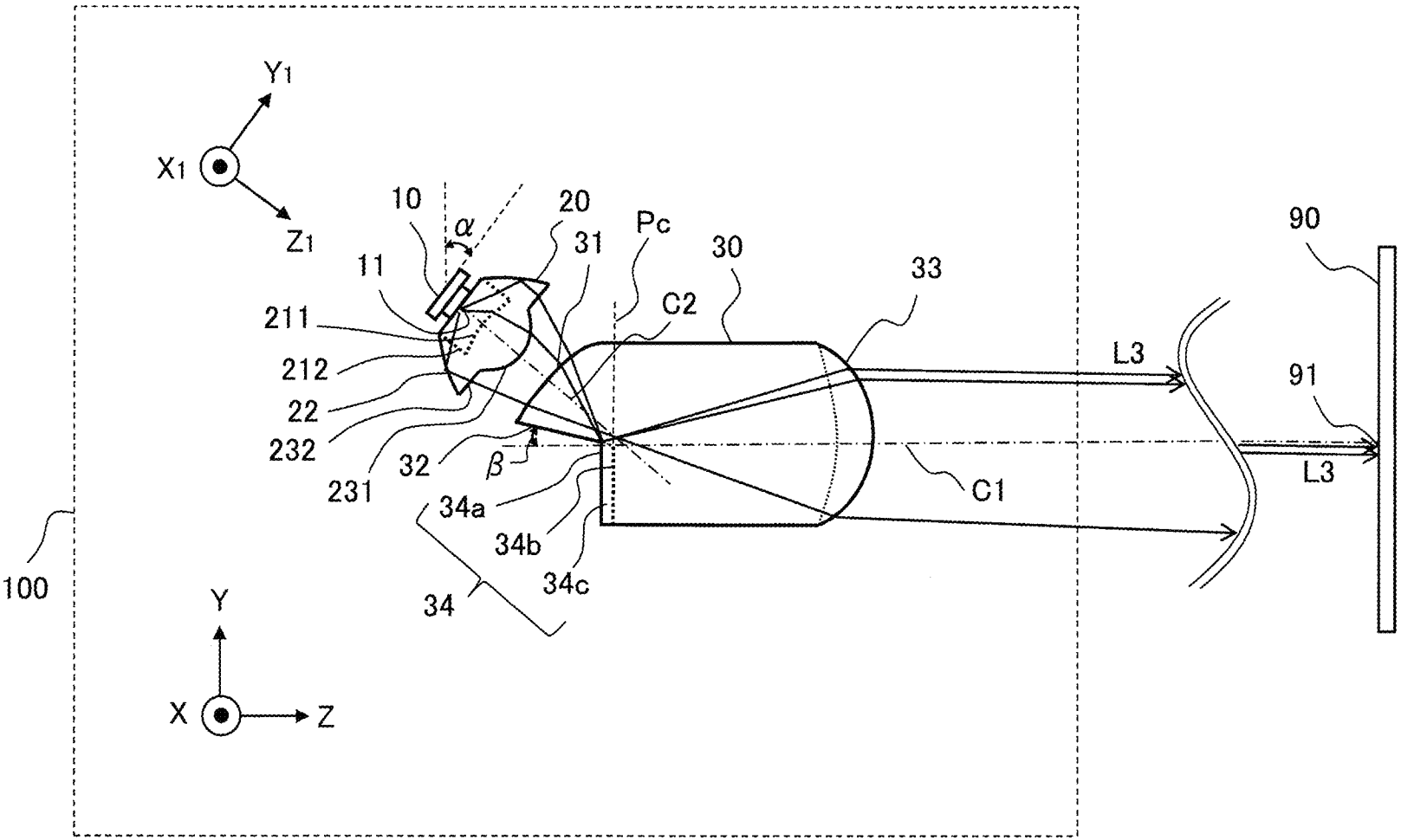
FIG. 1 is a side view schematically showing a configuration example of a headlight module according to a first embodiment of the present invention.

Headlight modules and a headlight device including one or more headlight modules according to embodiments of the present invention will be described below with reference to the drawings. Throughout the drawings, components identical or similar to each other are assigned the same reference character. The following embodiments are just examples and a variety of modifications are possible within the scope of the present invention.

In the drawings, coordinate axes of an XYZ orthogonal coordinate system are shown in order to facilitate the understanding of the invention. An X-axis is a coordinate axis extending in a transverse direction of a vehicle equipped with the headlight module. When facing a forward direction of the vehicle, the right side corresponds to a +X-axis direction and the left side corresponds to a −X-axis direction. The "forward direction" is a traveling direction of the vehicle when the vehicle is traveling straight forward. Namely, the "forward direction" is the direction in which the headlight module emits light. A Y-axis is a coordinate axis extending in an up/Down direction of the vehicle. An upper side corresponds to a +Y-axis direction and a lower side corresponds to a −Y-axis direction. The "upper side" represents a direction pointing towards the sky, and the "lower side" represents a direction pointing towards the ground (e.g., road surface). A Z-axis is a coordinate axis extending in the traveling direction of the vehicle when the vehicle travels straight. The traveling direction of the vehicle when the vehicle travels straight forward is a +Z-axis direction, and the traveling direction of the vehicle when the vehicle travels straight backward is a −Z-axis direction. The +Z-axis direction referred to also as the "forward direction", and the −Z-axis direction is referred to also as a "backward direction".

A ZX plane is a plane parallel to the road surface. However, the road surface is inclined at an upward slope, a downward slope, a road inclined in its width direction, and so forth. Thus, there are cases where a horizontal plane as a plane orthogonal to the gravitational direction is not parallel to the road surface in reality. However, in the present application, the ZX plane as the plane parallel to the road surface is referred to also as the "horizontal plane".

The headlight module and the headlight device emit light in the forward direction of the vehicle, for example. The headlight device has to be capable of emitting light in a light distribution pattern that illuminates a region stipulated by a law or the like (hereinafter referred to as "road traffic rules"), The "light distribution" means luminosity of the headlight device in regard to each direction, that is, luminosity distribution. Namely, the "light distribution" is spatial intensity distribution of the light emitted from the headlight device. The "luminosity" is a physical quantity indicating how intense light is emitted from a light source. The luminosity is a value obtained by dividing luminous flux propagating in a minute solid angle in a certain direction by the minute solid angle.

In general, the road traffic rules require that the light distribution pattern of the low beam of the headlight device for an automobile be in a horizontally long shape that is short in the up/down direction and long in the transverse direction. Further, so as not to dazzle the drivers of oncoming vehicles, the road traffic rules require that a light boundary line (i.e., cutoff line) at the top of the light distribution pattern is distinct, Being "distinct" means that no major chromatic aberration, blurring or the like has occurred to the cutoff line. Namely, the road traffic rules require that a region above the cutoff line (i.e., outside the light distribution pattern) is sufficiently dark, a region below the cutoff line (i.e., inside the light distribution pattern) is sufficiently bright, and the cutoff line is sufficiently distinct.

Here, the "cutoff line" means a separator line between a bright region and a dark region formed when the light emitted from the headlight module is applied to a wall or a screen. In general, the cutoff line is a separator line existing at the top of the light distribution pattern. Namely, the cutoff line means a bright/dark boundary line of light at the top of the light distribution pattern. In other words, the cutoff line is a boundary line, at the top of the light distribution pattern, between a bright region (i.e., region inside the light distribution pattern) and a dark region (i.e., region outside the light distribution pattern). The cutoff line is a term that is used for explaining an illumination direction of a headlight used when automobiles pass by each other. The light distribution pattern of the headlight used when automobiles pass by each other is referred to also as the low beam.

The "light distribution pattern" indicates the shape of a light flux and light intensity distribution that are determined by the direction of light emitted from the light source. The "light distribution pattern" is used also in the meaning of an illuminance pattern on an illuminated surface. "Lighting distribution" means distribution of light intensity with respect to the direction of light radiated from the light source. The "lighting distribution" is used also in the meaning of illuminance distribution on the illuminated surface.

The headlight module according to each embodiment is used for the low beam emission, the high beam emission or the like of a headlight mounted on a vehicle. For example, the headlight module is used for headlights of motorcycles. The headlight module is used also for headlights of various types of vehicles such as three-wheel vehicles and four-wheel vehicles. The three-wheel vehicles include a motor tricycle called a Gyro, for example. The motor tricycle is a scooter with three wheels including one front wheel and uniaxial two rear wheels.

The following description will be given mainly of cases of forming the light distribution pattern of the low beam of: the headlight module for a motorcycle. In the light distribution pattern of the low beam of the headlight for a motorcycle, the cutoff line includes a straight line that is horizontal in the transverse direction of the vehicle (i.e., X-axis direction). Further, the region on the lower side of the cutoff line (i.e., on the inside of the light distribution pattern) is the brightest.

(1) First Embodiment

Figure 2:
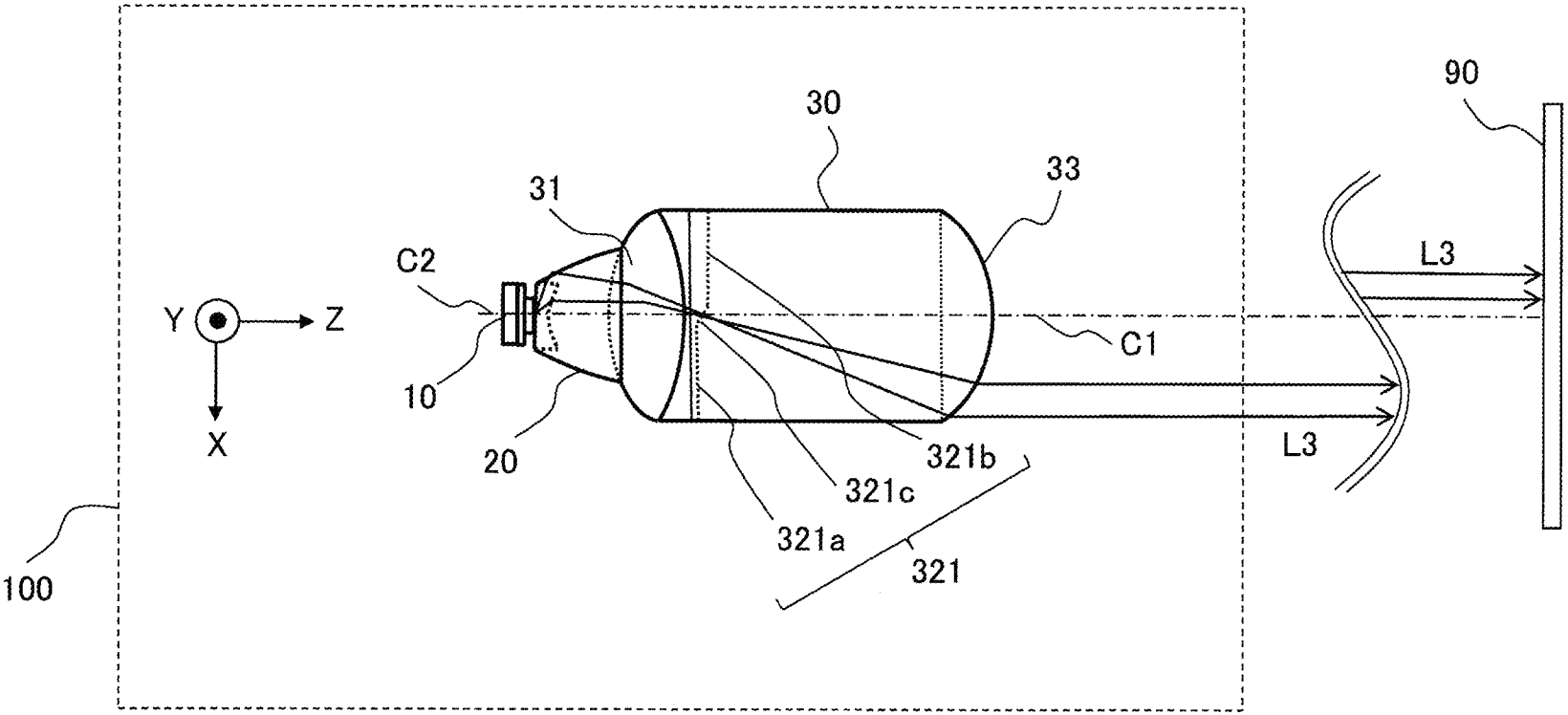
FIG. 2 is a top view schematically showing the configuration example of the headlight module according to the first embodiment.

FIG. 1 is a side view schematically showing a configuration example of a headlight module 100 according to a first embodiment. FIG. 2 is a top view schematically showing the configuration example of the headlight module 100. FIG. 1 shows a side face of the headlight module 100 as viewed from the right side of the vehicle. FIG. 2 shows a top surface of the headlight module 100 as viewed from above the vehicle.

As shown in FIG. 1 and FIG. 2, the headlight module 100 includes a light source 10 that emits first light and a light guide projection optical element 30 as a first optical unit. Further, the headlight module 100 may include a condensing optical element 20 as a second optical unit. The condensing optical element 20 may be attached to the light source 10. Further, the light source 10 and the condensing optical element 20 may have integrated structure.

An optical axis of the light source 10 and an optical axis of the condensing optical element 20 are a common optical axis C2. The light source 10 and the condensing optical element 20 are arranged so that the optical axis C2 is inclined with respect to the Z axis by an angle $\alpha$. It is permissible even if the angle $\alpha$ is 0 degrees. However, light utilization efficiency increases if the light source 10 and the condensing optical element 20 are arranged so that the optical axis C2 is inclined with respect to the Z axis by an angle greater than 0 degrees as shown in FIG. 1.

In the description of the light source 10 and the condensing optical element 20, an $X_1Y_1Z_1$ orthogonal coordinate system different from the XYZ orthogonal coordinate system is used in order to facilitate the understanding. The $X_1Y_1Z_1$ orthogonal coordinate system is a coordinate system obtained by rotating the XYZ orthogonal coordinate system clockwise around the X-axis by the angle $\alpha$ as viewed from the +X-axis side. In the first embodiment, the optical axis C2 of the condensing optical element 20 is parallel to the $Z_1$-axis, <Light Source 10>

The light source 10 has a light-emitting surface 11 that emits light as the first light. From the viewpoint of lightening the odd on the environment such as reduction in carbon dioxide ($CO_2$) emission and reduction in fuel consumption, the light source 10 is desired to be a semiconductor light source having high luminous efficiency. The semiconductor light source is a light-emitting diode (LED) or a laser diode (LD), for example. The light source 10 can also be a lamp light source including a halogen bulb or the like. Further, the light source 10 can also be a solid-state light source. Examples of the solid-state light source include an organic electroluminescence (organic EL) light source, a light source that makes a fluorescent substance emit light by irradiating the fluorescent substance with pumping light, and so forth. The semiconductor light source is a type of the solid-state light source.

The light source 10 emits light, for illuminating a region in the forward direction from the vehicle, from the light-emitting surface 11. The light source 10 is situated on the $-Z_1$-axis side of the condensing optical element 20. The light source 10 is situated on the −Z-axis side (i.e., backward direction side) of the light guide projection optical element 30. The light source 10 is situated on the +Y-axis side (i.e., the upper side) of the light guide projection optical element 30. In FIG. 1 and FIG. 2, the light source 10 is emitting the light in the $+Z_1$-axis direction. While the type of the light source 10 is not particularly limited, the following description will be given of a case where the light source 10 is an LED.

<Condensing Optical Element 20>

The condensing optical element 20 is situated on the $+Z^1$-axis side of the light source 10. The condensing optical element 20 is situated on the $-Z_1$-axis side of the light guide projection optical element 30. The condensing optical element 20 is situated on the −Z-axis side (i.e., the backward direction side) of the light guide projection optical element 30. The condensing optical element 20 is situated on the +Y-axis side (i.e., the upper side) of the light guide projection optical element 30.

The light emitted from the light source 10 enters the condensing optical element 20. The condensing optical element 20 condenses the entered light at a position in front of (i.e., in the $+-Z_1$-axis direction from) the condensing optical element 20. The condensing optical element 20 is an optical element having the light-condensing function. In other words, the condensing optical element 20 is an optical element that changes the divergence angle and the convergence angle of the light emitted from the light source 10.

In FIG. 1 and FIG. 2, the condensing optical element 20 is shown as an optical element having positive power. Further, in the first embodiment, the condensing optical element 20 is an optical element filled in with a light transmissive refractive material.

In FIG. 1 and FIG. 2, the condensing optical element 20 is formed with one optical component. The condensing optical element 20 may be formed with a combination of a plurality of optical components. However, in a case where the condensing optical element 20 is formed with a combination of a plurality of optical components, it is necessary to secure sufficiently high positioning accuracy of each optical component. Therefore, the condensing optical element 20 is desired to be formed with one optical component.

The light source 10 and the condensing optical element 20 are arranged on the upper side (i.e., the +Y-axis side) of the light guide projection optical element 30. Further, the light source 10 and the condensing optical element 20 are arranged on the backward direction side (i.e., the −Z-axis side) of the light guide projection optical element 30.

The light source 10 and the condensing optical element 20 are situated on one side of a reflecting surface 32, as a first optical surface of the light guide projection optical element 30, on the side of the surface for reflecting light. Namely, the light source 10 and the condensing optical element 20 are situated on a front surface's side of the reflecting surface 32. The light source 10 and the condensing optical element 20 are situated on the front surface side of the reflecting surface 32 in regard to the normal direction of the reflecting surface 32. Namely, the condensing optical element 20 is arranged in a direction to face the reflecting surface 32.

The optical axis C2 of the light source 10 and the condensing optical element 20 has an intersection point with the reflecting surface 32. In cases where the light is refracted at an incidence surface 31 of the light guide projection optical element 30, a central ray of light emitted from the condensing optical element 20 reaches the reflecting surface 32. Namely, the optical axis C2 of the condensing optical element 20 or the central ray of light has an intersection point with the reflecting surface 32.

The condensing optical element 20 has incidence surfaces 211 and 212, a reflecting surface 22, and exit surfaces 231 and 232. The condensing optical element 20 is arranged immediately after the light source 10. Here, being "after" means being on a side in the traveling direction of the light emitted from the light source 10. Since the condensing optical element 20 is arranged immediately after the light source 10, the light emitted from the light-emitting surface 11 immediately enters the condensing optical element 20 through the incidence surfaces 211 and 212.

The LED emits light of Lambert distribution. The "Lambert distribution" is light distribution in which the luminance of the light-emitting surface is constant irrespective of the direction of viewing. In other words, the directivity of the LED's light distribution is wide. Therefore, reducing the distance between the light source 10 including the LED and the condensing optical element 20 makes it possible to have a greater amount of light enter the condensing optical element 20.

The condensing optical element 20 is rode of transparent resin, or glass or silicone material having light permeability, for example. In order to increase the light utilization efficiency, the material of the condensing optical element 20 is desired to be a material having high light permeability. Further, since the condensing optical element 20 is arranged immediately after the light source 10, the material of the condensing optical element 20 is desired to be a material excelling in heat resistance.

The incidence surface 211 is an incidence surface formed in a central part of the condensing optical element 20. The "central part of the condensing optical element 20" is a part where the optical axis C2 of the condensing optical element 20 has an intersection point with the incidence surface 211. The incidence surface 211 has a convex shape with positive power, for example. The convex shape of the incidence surface 211 is a shape that is convex in the $-Z_1$-axis direction. The power is referred to also as refractive power. The incidence surface 211 is in a rotationally symmetric shape centering at the optical axis C2 as the rotation axis, for example.

The incidence surface 212 is in a shape as a part of a surface shape of a body of rotation formed by rotating an ellipse around its major axis or minor axis as the rotation axis, for example. The body of rotation formed by rotating an ellipse around its major axis or minor axis as the rotation axis is referred to as a spheroid. The rotation axis of the spheroid coincides with the optical axis C2. The incidence surface 212 has a surface shape obtained by cutting away the spheroid's both ends in the rotation axis direction. In other words, the incidence surface 22 is in a tubular shape.

One end (i.e., end on the $+Z_1$-axis side) of the tubular shape of the incidence surface 212 is connected to the outer circumference of the incidence surface 211. The tubular shape of the incidence surface 212 is formed on the light source 10's side (in the $-Z_1$-axis direction) relative to the incidence surface 211. Namely, the tubular shape of the incidence surface 212 is formed on the light source 10's side of the incidence surface 211.

The shape of the reflecting surface 22 is a tubular shape whose cross-sectional shape on each $X_1Y_1$ plane is a circular shape centering at the optical axis C2, for example. In the tubular shape of the reflecting surface 22, the diameter of the circular shape on an $X_1Y_1$ plane at an end on the $-Z_1$-axis side is smaller than the diameter of the circular shape on an $X_1Y_1$ plane at an end on the $-Z_1$-axis side. In other words, the diameter of the reflecting surface 22 increases from the $-Z_1$-axis side towards the $+Z_1$-axis side. For example, the reflecting surface 22 has a shape of a side face of a circular truncated cone. The shape of the circular truncated cone's side face on a plane including the central axis of the circular truncated cone is a linear shape. However, the shape of the reflecting surface 22 on a plane including the optical axis C2 may also be a curved line shape. The "plane including the optical axis C2" means a plane on which the line of the optical axis C2 can be drawn.

One end (i.e., end on the $-Z_1$-axis side) of the tubular shape of the reflecting surface 22 is connected to the other end (i.e., end on the $-Z_1$-axis side) of the tubular shape of the incidence surface 212. In other words, the reflecting surface 22 is situated on the outer circumferential side of the incidence surface 212.

The exit surface 231 is situated on the +Z-axis side of the incidence surface 211. The exit surface 231 has a convex shape with positive power. The convex shape of the exit surface 231 is a shape that is convex in the $+Z_1$-axis direction. The optical axis C2 of the condensing optical element 20 has an intersection point with the exit surface 231. The exit surface 231 has a rotationally symmetric shape centering at the optical axis C2 as the rotation axis, for example.

The exit surface 232 is situated on the outer circumferential side of the exit surface 231. The exit surface 232 has a planar shape parallel to the $X_1Y_1$ plane, for example. The inner circumference and the outer circumference of the exit surface 232 have circular shapes. The inner circumference of the exit surface 232 is connected to the outer circumference of the exit surface 231. The outer circumference of the exit surface 232 is connected to the other end (i.e. end on the $+Z_1$-axis side) cf the tubular shape of the reflecting surface 22.

Out of the light emitted from the light-emitting surface 11, a light beam having a small emission angle (i.e., divergence angle) is incident on the incidence surface 211. The light beam having a small emission angle is a light beam whose divergence angle is within 60 degrees, for example. The light beam having a small emission angle enters the condensing optical element 20 through the incidence surface 211 and is emitted from the exit surface 231. The light beam of a small emission angle emitted from the exit surface 31 is condensed, and is condensed at a position in front of (i.e. in the $+Z_1$-axis direction from) the condensing optical element 20.

Out of the light emitted from the light-emitting surface 11, a light beam having a large emission angle is incident on the incidence surface 212. The divergence angle of the light beam having a large emission angle is larger than 60 degrees, for example. The light beam entering the condensing optical element 20 through the incidence surface 212 is reflected by the reflecting surface 22. The light beam reflected by the reflecting surface 22 travels in the $-Z_1$-axis direction. The light beam reflected by the reflecting surface 22 is emitted from the exit surface 232. The light beam of a large emission angle emitted from the exit surface 232 is condensed, and is condensed at a position in front of (i.e., in the $-Z_1$-axis direction from) the condensing optical element 20.

The condensing optical element 20 is explained as an optical element having the following functions: The condensing optical element 20 condenses rays of light emitted from the light source 10 at small emission angles by means of refraction. Meanwhile, the condensing optical element 20 condenses rays of light emitted from the light source 1 at large emission angles by means of reflection. However, the shape of the condensing optical element 20 is not limited to the shape illustrated in the drawings.

For example, the condensing position of the light emitted from the exit surface 231 is determined by the light distribution pattern of the light emitted from the light-emitting surface 11 of the light source 10, and thus there are cases where the light distribution irregularity occurs due to the projection of the shape of the light-emitting surface 11. In the first embodiment, the light distribution irregularity can be reduced by setting the condensing position of the light emitted from the exit surface 231 and the condensing position of the light emitted from the exit surface 232 at positions different from each other. Namely, the condensing position of the light emitted from the exit surface 232 and the condensing position of the light emitted from the exit surface 231 do not need to coincide with each other. For example, the condensing position of the light emitted from the exit surface 232 may be closer to the condensing optical element 20 than the condensing position of the light emitted from the exit surface 231.

In the first embodiment, all of the incidence surfaces 211 and 212, the reflecting surface 22 and the exit surfaces 231 and 232 of the condensing optical element 20 have rotationally symmetric shapes centering at the optical axis C2. However, the condensing optical element 20 is not limited to such a rotationally symmetric shape as long as the condensing optical element 20 has the function of appropriately condensing the light emitted from the light source 10.

For example, by configuring the reflecting surface 22 to have an elliptic cross-sectional shape on the $X_1X_1$ plane, a condensed light spot at the condensing position can also be formed in an elliptic shape. In this case, the headlight module 100 is facilitated to generate a wide light distribution pattern. Further, in a case where the light-emitting surface 11 of the light source 10 is in a rectangular shape, the condensing optical element 20 can be downsized by employing the configuration of the reflecting surface 22 having an elliptic cross-sectional shape on the $X_1Y_1$ plane, for example.

It is permissible if the condensing optical element 20 has positive power as a whole. Specifically, it is permissible even if at least one of the incidence surfaces 211 and 212, the reflecting surface 22 and the exit surfaces 231 and 232 has negative power.

In cases where the light source 10 includes a tube/bulb light source, a reflecting mirror may be provided instead of or in addition to the condensing optical element 20. The reflecting mirror is, for example, a concave mirror such as a spheroidal mirror or a revolution paraboloidal mirror.

<Light Guide Projection Optical Element 30>

The light guide projection optical element 30 as the second optical system is situated in the $+Z_1$-axis direction from the condensing optical element 20. The light guide projection optical element 30 is situated on the +Z-axis side of the condensing optical element 20. The light guide projection optical element 30 is situated on the −Y-axis side of the condensing optical element 20.

The light emitted from the condensing optical element 20 enters the light guide projection optical element 30. The light guide projection optical element 30 emits the light in the forward direction (i.e., the +Z-axis direction). The light guide projection optical element 30 has a function of guiding the entered light by using the reflecting surface 32. Further, the light guide projection optical element 30 has a function of projecting the guided light as illuminating light L3 by using the exit surface 33.

Figure 3:
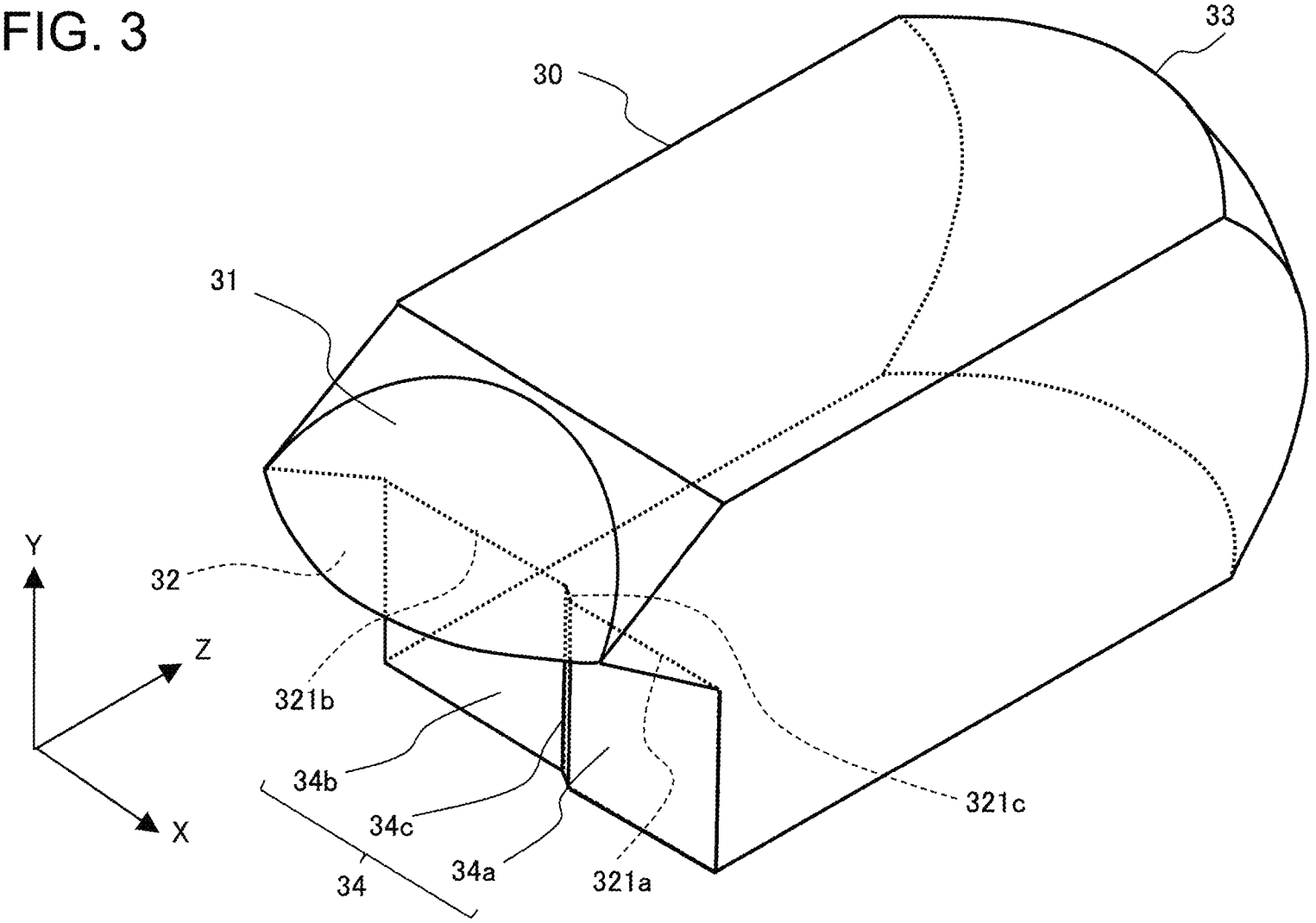
FIG. 3 is a perspective view schematically showing a light guide projection optical element of the headlight module according to the first embodiment.
Figure 4:
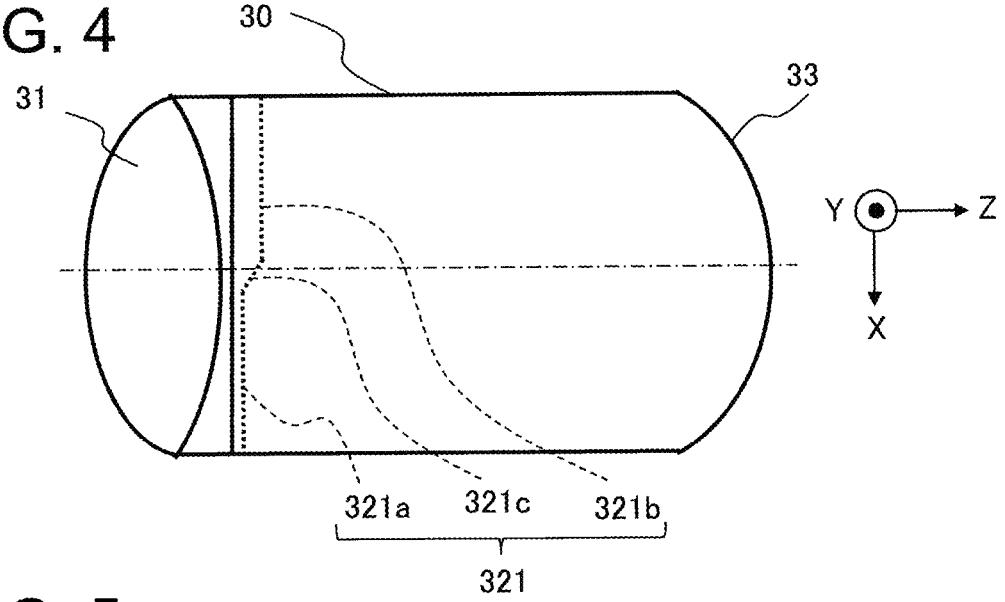
FIG. 4 is a top view schematically showing the light guide projection optical element shown in FIG. 3.
Figure 5:
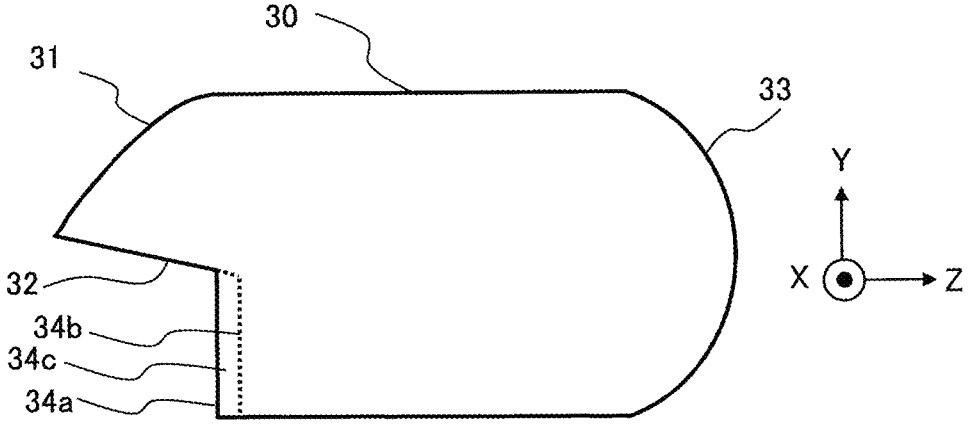
FIG. 5 is a side view schematically showing the light guide projection optical element shown in FIG. 3.
Figure 6:
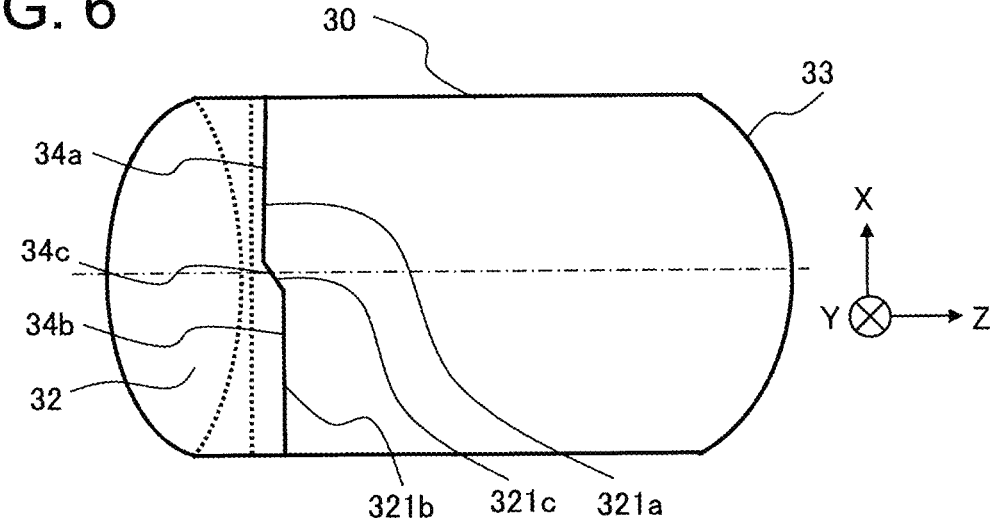
FIG. 6 is a bottom view schematically showing the light guide projection optical element shown in FIG. 3.

FIG. 3 is a perspective view schematically showing the light guide projection optical element 30. FIG. 4, FIG. 5 and FIG. 6 are a top visa, a side view and a bottom view schematically showing the light guide projection optical element 30 shown in FIG. 3. The light guide projection optical element 30 has the reflecting surface 32 as the first optical surface and the exit surface 33 as a lens surface. The light guide projection optical element 30 may have the incidence surface 31. Further, the light guide projection optical element 30 may have an incidence surface 34.

The light guide projection optical element 30 is made of transparent resin, light transmissive glass or silicone material, or the like, for example. Further, the light guide projection optical element 30 in the first embodiment is filled in with a light transmissive refractive material, for example.

The incidence surface 31 is formed at an end of the light guide projection optical element 30 on the −Z-axis side. The incidence surface 31 is formed on a part of the light guide projection optical element 30 on the +Y-axis side. In FIG. 1 to FIG. 6, the incidence surface 31 of the light guide projection optical element 30 is in a curved surface shape. The curved surface shape of the incidence surface 31 is, for example, a convex shape having positive power both in the horizontal direction the X-axis direction) and in the vertical direction (i.e., the Y-axis direction).

The light incident on the incidence surface 31 in the curved surface shape changes its divergence angle. The incidence surface 31 is capable of forming the light distribution pattern by changing the divergence angle of the light. Namely, the incidence surface 31 has a function of forming the shape of the light distribution pattern. Thus, the incidence surface 31 functions as a light distribution pattern shape formation unit.

For example, it is also possible to leave out the condensing optical element 20 by providing the incidence surface 31 with the light-condensing function. Namely, the incidence surface 31 may have a shape for functioning as a condensing optical element. The incidence surface 31 shown in FIG. 1 to FIG. 6 is an example of the light distribution pattern shape formation unit. However, the incidence surface 31 is not limited to a curved surface shape but can also be in a planer shape, for example.

In the first embodiment, a description will be given first of a case where the shape of the incidence surface 31 of the light guide projection optical element 30 is a convex shape having positive power. Further, in the first embodiment, a description will be given of a case where the cutoff line is in a shape having a step. Incidentally, a case where the shape of the incidence surface 31 of the light guide projection optical element is a concave shape having negative power will be described later by using FIG. 17 to FIG. 20.

The reflecting surface 32 is formed at an end of the incidence surface 31 on the −Y-axis side, Namely, the reflecting surface 32 is arranged on the −Y-axis side of the incidence surface 31. The reflecting surface 32 is arranged on the +Z-axis side of the incidence surface 31. In the first embodiment, an end of the reflecting surface 32 on the −Z-axis side is connected to the end of the incidence surface 31 on the −Y-axis side.

The reflecting surface 32 reflects light reaching the reflecting surface 32 as shown in FIG. 1. In other words, the reflecting surface 32 has a function of reflecting light. Thus, the reflecting surface 32 functions as a light-reflecting part. The reflecting surface 32 is an example of the light-reflecting part.

As shown in FIG. 1 to FIG. 6, the reflecting surface 32 is a surface approximately facing the +Y-axis direction. Specifically, the front surface of the reflecting surface 32 is a surface ined with respect to the +Y-axis direction by an inclination angle β. The front surface of the reflecting surface 32 is a surface that reflects light. A back surface of the reflecting surface 32 is a surface approximately facing the −Y-axis direction.

The reflecting surface 32 is a surface that is rotated with respect to the ZX plane clockwise around an axis parallel to the X-axis as viewed from, the +X-axis side. In the example shown in FIG. 1, the reflecting surface 32 is a surface that is rotated with respect to the ZX plane by the angle β. It is permissible even if the angle β is 0 degrees. However, the light utilization efficiency increases when the angle β is greater than 0 degrees.

In FIG. 1 toy FIG. 6, the reflecting surface 32 is shown as a plane. However, the reflecting surface 32 can also be in a shape other than a plane. The reflecting surface 32 can also be in a curved surface shape or a multifaceted shape formed by connecting a plurality of planes. For example, the reflecting surface 32 can be in a cylindrical shape having curvature in the vertical direction (i.e., the Y-axis direction) and no curvature in the horizontal direction (i.e., the X-axis direction). Further, the reflecting surface 32 can be in a multifaceted shape approximating curves of a curved surface shape in a cylindrical shape.

Furthermore, the reflecting surface 32 is not limited to the above-described examples but can have curvature in the X-axis direction. The reflecting surface 32 can also be a curved surface having curvature in the X-axis direction and curvature in the Y axis direction. The reflecting surface 32 can also be in a multifaceted shape approximating a curved surface having curvature in the X-axis direction and curvature in the Y-axis direction. The multifaceted shape is not limited to shapes approximating a curved surface. However, from the viewpoint of reducing the light distribution irregularity, the reflecting surface 32 is desired to include no surface inclined in the transverse direction (i.e., the X-axis direction) as will be described later. Further, even though it is permissible even if the reflecting surface 32 includes a surface inclined in the transverse direction (i.e., the X-axis direction) as will be described later, it is more preferable if the area of the inclined surface is smaller from the viewpoint of reducing the light distribution irregularity.

The reflecting surface 32 can be a mirror surface formed by means of mirror vapor deposition using metal or the like. However, it is desirable to make the reflecting surface 32 function as a total reflection surface without conducting the mirror vapor deposition. That is because the total reflection surface has higher reflectivity than the mirror surface and contributes to the increase in the light utilization efficiency. Further, that is because eliminating the mirror vapor deposition step can simplify the manufacturing process of the light guide projection optical element 30 and contribute to the reduction of the production cost. Especially in the configuration in the first embodiment, the reflecting surface 32 can be formed as the total reflection surface without the need of conducting the mirror vapor deposition since the incidence angle of the light beam on the reflecting surface 32 is large.

The incidence surface 34 includes a plane parallel to the XY plane, for example. However, the incidence surface 34 can be a curved surface. By forming the incidence surface 34 as a curved surface, the light distribution of the light entering the light guide projection optical element 30 through the incidence surface 34 can be changed. The light entering the light guide projection optical element 30 through the incidence surface 34 is referred to also as second light. The incidence surface 34 is arranged on the −Y-axis side of the reflecting surface 32. Namely, the incidence surface 34 is arranged on the back surface's side of the reflecting surface 32. Incidentally, a light source that emits the second light will be described later by using FIG. 21.

Further, in the first embodiment, the incidence surface 34 includes an incidence surface 34*a*, an incidence surface 34*b* and an incidence surface 34*c*. The incidence surface 34*a* the incidence surface 34*b* and the incidence surface 34*c* correspond to a ridge line part 321*a*, a ridge line part 321*b* and a ridge line part 321*c* as parts (i.e., end part positions) of a ridge line part 321 on the +Z-axis side of the reflecting surface 32 corresponding to a cutoff line shape which will be described later.

In the first embodiment, the incidence surface 34*a* is situated on the −Z-axis side of the incidence surface 34*b*. The incidence surface 34*c* is a surface connecting the incidence surface 34*a* and the incidence surface 34*h*. In the first embodiment, the incidence surface 34*a* is situated on the +X-axis side of the incidence surface 34*b*. The example shown in FIG. 1 to FIG. 6 is an example of emitting a light distribution pattern in which the position i.e., height) of the cutoff line on the left side (i.e., the −X-axis side) is lower than the position of the cutoff line on, the right side (i.e., the +X-axis side). To form such a light distribution pattern, the incidence surface 34*a* situated on the +X-axis side of the incidence surface 34*c* is arranged on the −Z-axis side of the incidence surface 34*b* situated on the −X-axis side of the incidence surface 34*c*.

Ends of the incidence surfaces 34*a*, 34*b* and 34*c* on the +Y axis side connect to the corresponding parts of the ridge lie part 321 on the +Z-axis side of the reflecting surface 32, For example, the end of the incidence surfaces 34*a* on the +Y-axis side connects to the ridge line part 321*a* in the ridge line part 321 on the +Z axis side of the reflecting surface 32, The end of the incidence surfaces 34*b* on the +Y-axis side connects to the ridge line part 321*h* in the ridge line part 321 on the +Z-axis side of the reflecting surface 32. The end of the incidence surfaces 34*c* on the +Y-axis side connects to the ridge line part 321*c* in the ridge line part 321 on the +Z-axis side of the reflecting surface 32.

In FIG. 1 to FIG. 6, the incidence surface 34*h* is situated at a position optically conjugate with an illuminated surface 90. Being "optically conjugate" represents a relationship between two points when light emitted from one point forms an image at another point. Thus, the shape of light on a conjugate surface Pc situated on a surface including the incidence surface 34*h* is projected onto the illuminated surface 90.

In FIG. 1 to FIG. 6, no light enters the light guide projection optical element 30 through the incidence surface 34.

Therefore, the shape of entered light, which enters from the incidence surface 31, on the conjugate surface Pc is projected onto the illuminated surface 90.

The ridge line part 321 is a side of the reflecting surface 32 on the +Z-axis side. While the ridge line part 321 is a side of the reflecting surface 32 on the −Y-axis side in FIG. 1 to FIG. 6, this does not apply depending on the presence/absence or the direction of inclination of the reflecting surface 32. Further, the ridge line part 321 includes a part situated at a position optically conjugate with the illuminated surface 90 (i.e., the ridge line part 321*b* in the example of FIG. 1 to FIG. 6).

The "ridge line" generally means a boundary line between a surface and a surface. However, the "ridge line" used here is not limited to a boundary line between a surface and a surface but is a concept including an edge part of a surface. In the first embodiment, the ridge line part 321 is a part connecting the reflecting surface 32 and the incidence surface 34. Namely, a part where the reflecting surface 32 and the incidence surface 34 connect to each other is the ridge line part 321.

However, in a case where the inside of the light guide projection optical element 30 is hollow and the incidence surface 34 is an opening, for example, the ridge line part 321 is an edge part of the reflecting surface 32. Namely, the ridge line part 321 can be an edge part of a surface, Incidentally, in the first embodiment, the light guide projection optical element 30 is filled in with a refractive material as mentioned earlier. Further, the "ridge line" is not limited to a straight line but can also be a curved line or the like. In the first embodiment, the ridge line part 321 is formed in a shape corresponding to a cutoff line shape including a "rising line".

In the first embodiment, the ridge line part 321 is a side of the incidence surface 34 on the +Y-axis side. In the first embodiment, the ridge line part 321 includes a part of the light guide projection optical element 30 intersecting with an optical axis C1 (i.e., the ridge line part 321*c* the example shown in FIG. 1 FIG. 6). In FIG. 1 to FIG. 6, the ridge line part 321 intersects with the optical axis C1 of the light guide projection optical element 30 at an angle other than the right angle. However, depending on the cutoff line shape, the ridge line part 321 may orthogonally intersect with the optical axis C1 of the light guide projection optical element 30.

The optical axis C1 is a normal line passing through a surface vertex of the exit surface 33. In the case of FIG. 1 to FIG. 6, the optical axis C1 is an axis passing through the surface vertex of the exit surface 33 and parallel to the Z-axis. Thus, when the surface vertex of the exit surface 33 is translated in the X-axis direction or the Y-axis direction on an XY plane, the optical axis C1 is also similarly translated in the X-axis direction or the Y-axis direction. Further, when the exit surface 33 is inclined with respect to the XY plane, the normal line to the surface vertex of the exit surface 33 is also inclined with respect to the XY plane and thus the optical axis C1 is also inclined with respect to the XY plane.

The exit surface 33 is formed at an end of the light guide projection optical element 30 on the +Z-axis side. The exit surface 33 is in a curved surface shape having positive power. The exit surface 33 is in a convex shape projecting in the +Z-axis direction.

In the example shown in FIG. 1 to FIG. 6, the shape of light on the conjugate surface Pc, formed corresponding to the shape of the ridge line part 321*b* of the reflecting surface 32, is projected onto the illuminated surface 90. In the example shown in FIG. 1 to FIG. 6, the shape of light on the conjugate surface Pc as a plane obtained by extending the incidence surface 34*b* in the +X-axis direction and the +Y-axis direction is projected onto the illuminated surface 90. Namely, a surface including the ridge line part 321*b* and orthogonal to the ZX plane is in the conjugate relationship with the illuminated surface 90. Here, the surface orthogonal to the ZX plane can be a curved surface. This curved surface is, for example, a surface having curvature in the horizontal direction (i.e., the X-axis direction).

Further, the conjugate surface Pc can also be, for example, a surface formed by extending a virtual ridge line, which is obtained by smoothly extending in the X-axis direction an edge shape of an edge portion of the ridge line part 321 described later corresponding to a part of the projected light distribution pattern where a luminance gradient is desired to be the steepest, in the vertical direction. The edge portion in the first embodiment is a part closest to the exit surface 33, and is a part corresponding to the ridge line part 321*b* corresponding to a cutoff line 91*b* shown in FIG. 12 which will be explained later. Here, if the ridge line part 321*b* is a curved surface, the virtual ridge line part is also a curved surface and the conjugate surface Pc is also a curved surface.

The position of the conjugate surface Pc is desired to be set so as to include a part of the ridge line part corresponding to a position where an illuminance gradient of the projected light distribution pattern in the vertical direction is the highest in the cutoff line 91. Namely, the conjugate surface Pc is desired to include a part of the ridge line part corresponding to a position where the luminosity gradient of the light distribution pattern, emitted from the headlight module 100, in the vertical direction per unit solid angle is the highest. Incidentally, while an example in which the conjugate surface Pc is a plane orthogonal to the ZX plane is shown in the example of FIG. 1 to FIG. 6, the conjugate surface Pc is not limited to a plane but can also be a different type of surface as long as the surface includes a focal point on the exit surface 33's side.

In the first embodiment, the reflecting surface 32 has no step in the height direction (i.e., the Y-axis direction). Namely, the reflecting surface 32 is one plane or curved surface. Here, the step in the height direction means a bent line shape drawn by the reflecting surface 32 as viewed on the XY plane due to existence of parts of the reflecting surface 32 at different heights with respect to a reference surface (i.e., surface parallel to the ZX plane).

The ridge line part 321 may include two or more parts differing in the position in the direction of the optical axis C1 of the exit surface 33 as shown in FIG. 1 to FIG. 6. In the example shown in FIG. 1 to FIG. 6, the ridge line part 321 includes the ridge line part 321*a*, the ridge line part 321*b* and the ridge line part 321*c* differing from each other in the position in a direction orthogonal to the optical axis C1 (i.e., the X direction). In the first embodiment, at least the ridge line part 321*a* and the ridge line part 321*b* differ in the position in the optical axis C1 direction. The ridge line part 321 draws a bent line shape as viewed on the ZX plane (more specifically, a plane including the ridge line part 321 and the exit surface 33 and parallel to the optical axis C1). Corresponding to the bent line shape of the ridge line part 321, the incidence surface 34 has a step in the Z-axis direction (i.e., the optical axis C1 direction).

The ridge line part 321*a* includes a point whose position in the optical axis C1 direction is the closest to the incidence surface 34. The ridge line part 321*b* includes a point whose position in the optical axis C1 direction is the closest to the exit surface 33. The ridge line part 321*c* is a part: connecting the ridge line part 321*a* and the ridge line part 321*b*.

On the ZX plane, the angle or curvature (i.e., curvature in the Y-axis direction) between the ridge line part 321*a* and the optical axis C1 differs from the angle or curvature (i.e., curvature in the Y-axis direction) between the ridge line part. 321*c* and the optical axis C1. Further, on the ZX plane, the angle or curvature (i.e., curvature in the Y-axis direction) between the ridge line part 321*c* and the optical axis C1 differs from the angle or curvature (i.e., curvature in the Y-axis direction) between the ridge line part 321*c* and the optical axis C1. For example, in the example shown in FIG. 1 to FIG. 6, the ridge line part 321*a* is in the orthogonal relationship with the optical axis C1, whereas the ridge line part 321*c* connected to the ridge line part 321*a* is not in the orthogonal relationship with the optical axis C1. Similarly, while the ridge line part 321*c* is not in the orthogonal relationship with the optical axis C1, the ridge line part 321*b* connected to the ridge line part 321*c* is in the orthogonal relationship with the optical axis C1.

For example, when the reflecting surface 32 includes the ridge line part 321 shown, in FIG. 1 to FIG. 6 and the conjugate surface Pc is set along the ridge line part 321*b*, the shape of the ridge line part 321*b* of the reflecting surface 32 is projected onto the illuminated surface 90. Further, a light distribution pattern formed on the conjugate surface Pc by a part of the light entering the light guide projection optical element 30 through the incidence surface 31 that is reflected by the reflecting surface 32 and passes by the ridge line part 321*a* and the ridge line part 321*b* on their +Y-axis side is also projected onto the illuminated surface 90.

Figure 7:
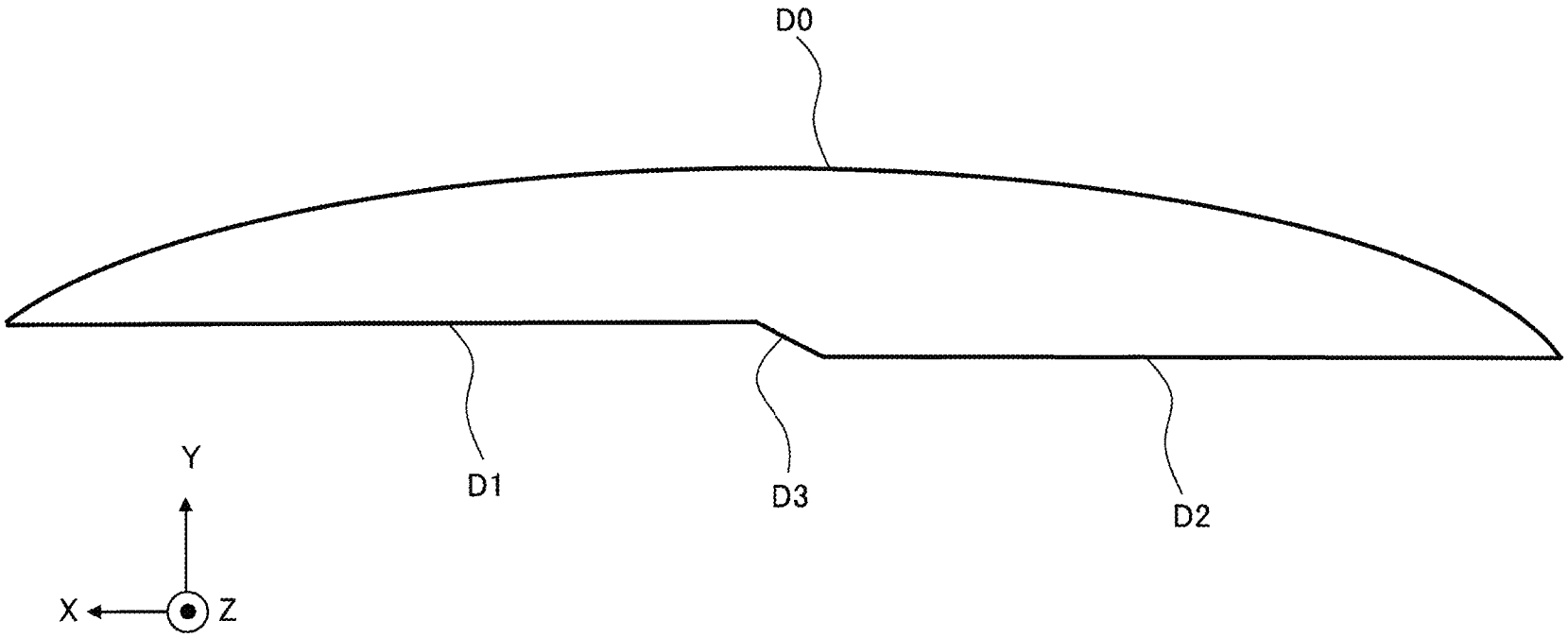
FIG. 7 is a diagram showing a light distribution pattern of illuminating light projected by the headlight module according to the first embodiment.

FIG. 7 is a diagram showing the light distribution pattern of the illuminating light L3 projected by the headlight module 100. A light distribution pattern formed by the ridge line part 321 on a part of the conjugate surface Pc on the +Y-axis side relative to the height of the ridge line part 321*b* is a light distribution pattern like that shown in FIG. 7, for example. The light distribution pattern shown in FIG. 7 is superimposition of light distribution patterns formed on the conjugate surface Pc by a part of the entered light entering the light guide projection optical element 30 through the incidence surface 31 that is reflected by the reflecting surface 32 and passes by the ridge line part 321*b* on its +Y-axis side, a part of the entered light that is not reflected by the reflecting surface 32 and passes by the ridge line part 321 on its +Y-axis side, and a part of the entered light that is reflected by the reflecting surface 32 and passes by the ridge line part 321*a* and the ridge line part 321*b* on their +Y-axis side. A straight line part D2 at the lower end of the light distribution pattern D0 shown in FIG. 7 corresponds to the ridge line part 321*b*. A straight line part D2 at the lower end of the light distribution pattern D0 shown in FIG. 7 corresponds to the ridge line part 321*a*. A straight line part D3 at the lower end of the light distribution pattern D0 shown in FIG. 7 corresponds to the ridge line part 321*c*.

In the first embodiment, the ridge line part 321*a* is not on the conjugate surface Pc. Namely, the ridge line part 321*a* is situated at a position different from the conjugate surface Pc. However, light that is reflected by the reflecting surface 32 and passes by the ridge line part 321*a* on its upper side (i.e., the +Y-axis side) maintains the linear shape of the ridge line part 321*a* on the conjugate surface Pc. Similarly, a part of the ridge line part 321*c* is not on the conjugate surface Pc. Namely, a part of the ridge line part 321*c* is situated at a position different from the conjugate surface Pc. However, light that is reflected by the reflecting surface 32 and passes by the ridge line part 321*c* on its upper side (i.e., the +Y-axis side) maintains the linear shape of the ridge line part 321*c* on the conjugate surface Pc. As above, a cutoff line corresponding to the shape of the ridge line part 321 of the reflecting surface 32 is formed.

With such a configuration, a cutoff line corresponding to the shape of the ridge line part 321 of the reflecting surface 32 can be formed without forming a step in the height direction of the reflecting surface 32 (i.e., the Y-axis direction). Accordingly, the light distribution irregularity due to reflected light from the step of the reflecting surface 32 can be inhibited.

Figure 24:
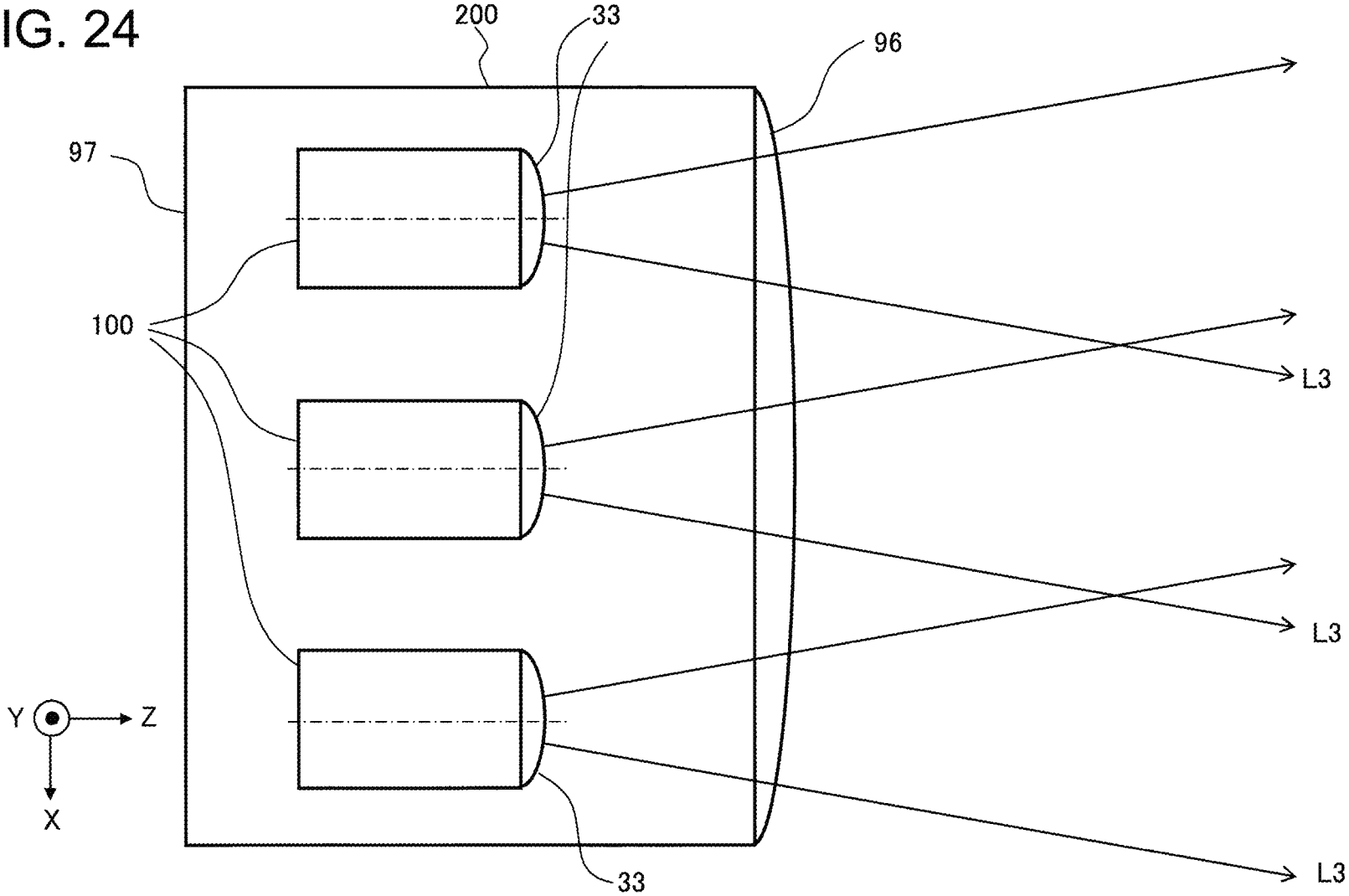
FIG. 24 is a top view schematically showing a configuration example of a headlight device according to a sixth embodiment of the present invention.

An image of light on the conjugate surface Pc is formed on a part of the conjugate surface Pc that is inside the light guide projection optical element 30. In other words, the light distribution pattern can be formed in a shape suitable for the headlight module 100 within the range of the conjugate surface Pc inside the light guide projection optical element 30. For example, when one light distribution pattern is formed by using a plurality of headlight modules 100 as shown in FIG. 24 which will be explained later, a light distribution pattern depending on respective roles of the plurality of headlight modules 100 can be formed.

The illuminated surface 90 is a virtual surface that is set at a predetermined position in the forward direction from the vehicle. The illuminated surface 90 is a surface parallel to the XY plane. The predetermined position in the forward direction from the vehicle is a position where the luminosity or the illuminance of the headlight device is measured, which is stipulated by the road traffic rules or the like, for example. For example, the luminosity measurement position for automobile headlight devices stipulated by UNECE (United Nations Economic Commission for Europe) in Europe is a position 25 meters from the light source. The luminosity measurement position stipulated by Japanese Industrial Standards Committee (JIS) in Japan is a position 10 meters from the light source.

<Behavior of Light Beam>

As shown in FIG. 1 to FIG. 6, the light condensed by the condensing optical element 20 enters the light guide projection optical element 30 through the incidence surface 31. The incidence surface 31 is a refracting surface. The light incident on the incidence surface 31 is refracted by the incidence surface 31, For example, the incidence surface 31 is a convex surface projecting in the −Z-axis direction. Here, the curvature of the incidence surface 31 in the X-axis direction contributes to a "light distribution width" in the horizontal direction with respect to the road surface. Further, the curvature of the incidence surface 31 in the Y-axis direction contributes to a "light distribution height" in the vertical direction with respect to the road surface.

<Behavior of Light Beam on ZX Plane>

As viewed on the ZX plane, in the example of FIG. 1 to FIG. 6, the incidence surface 31 has a convex shape. Namely, the incidence surface 31 has positive power in regard to the horizontal direction (i.e., the X-axis direction). Here, "as viewed on the uX plane" means as viewed from the +Y-axis side, Namely, "as viewed on the ZX plane" means as viewed while being projected on the ZX plane. Thus, the light incident on the incidence surface 31 is further condensed by the incidence surface 31 and propagates in the light guide projection optical element 30. Here, to "propagate" means that light travels in the light guide projection optical element 30.

Figure 8:
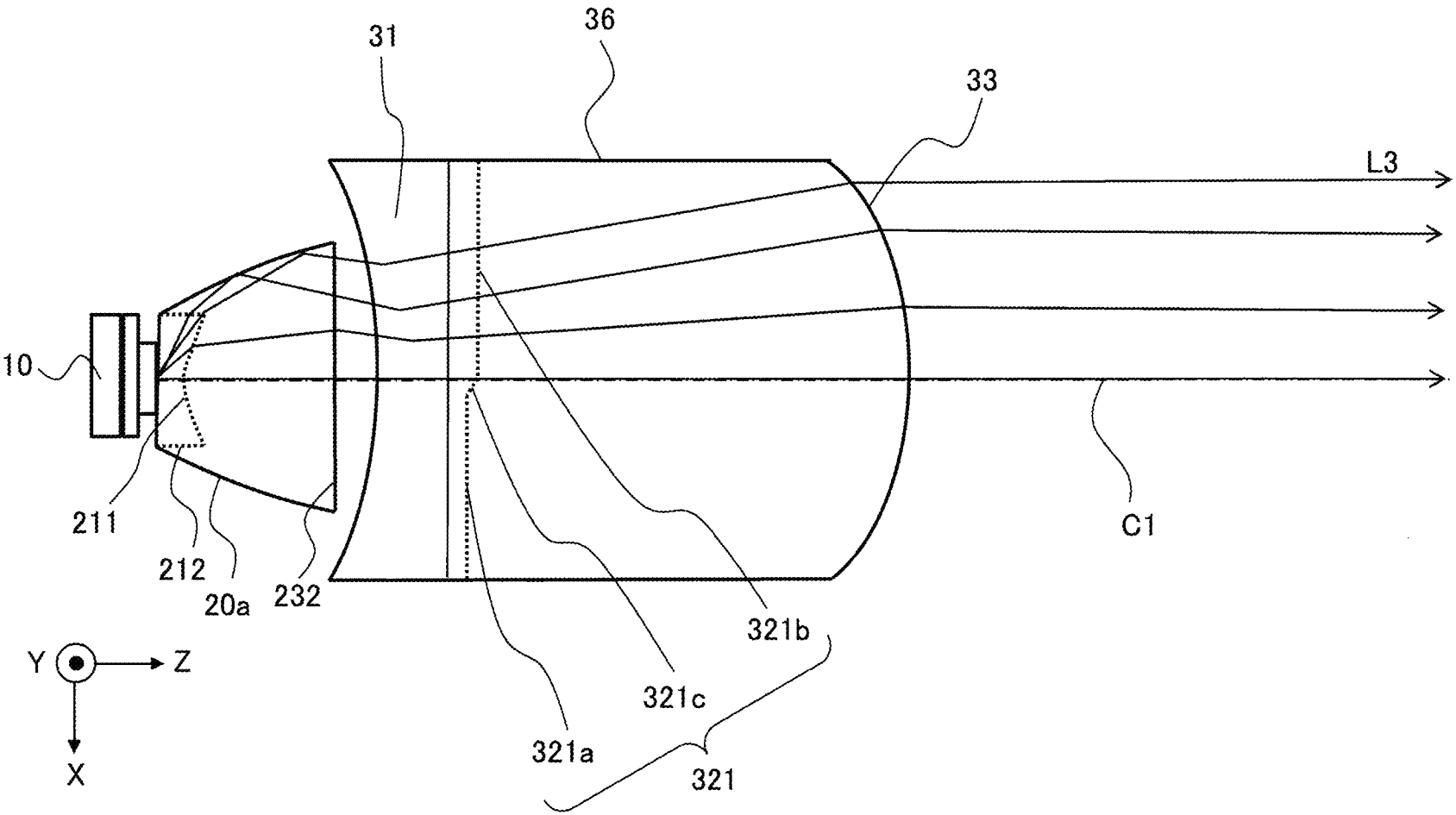
FIG. 8 is a top view showing principal rays of light passing through a light guide projection optical element of a headlight module according to a modification of the first embodiment.
Figure 9:
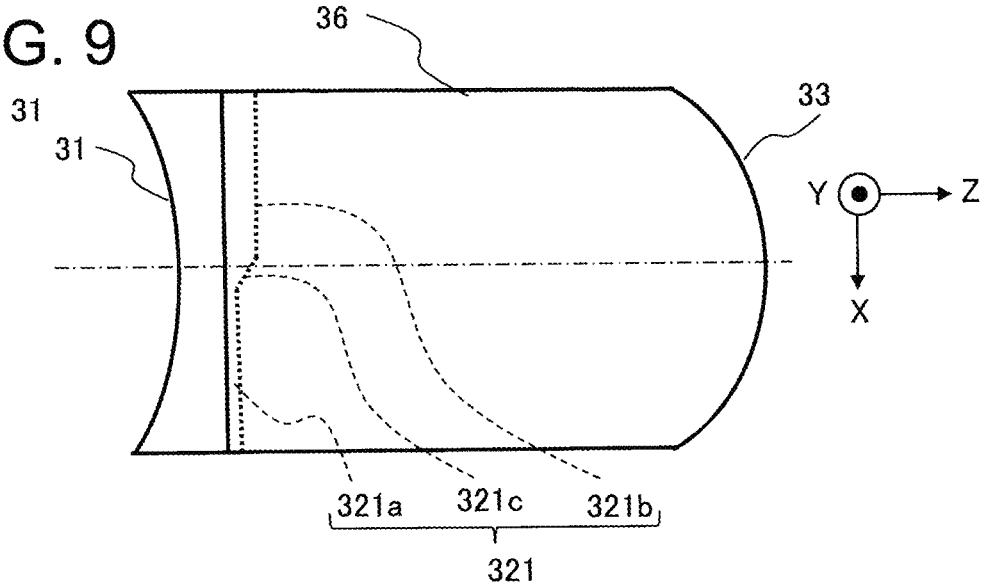
FIG. 9 is a top view schematically showing the light guide projection optical element shown in FIG. 8.
Figure 10:
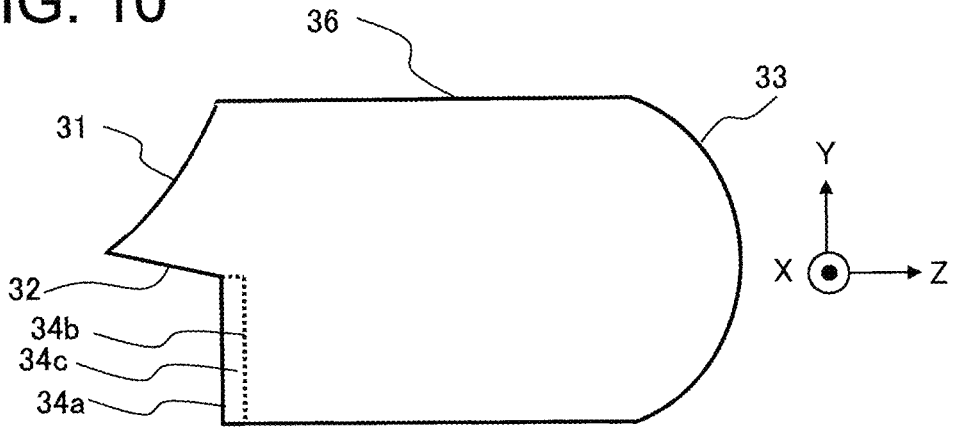
FIG. 10 is a side view schematically showing the light guide projection optical element shown in FIG. 8.
Figure 11:
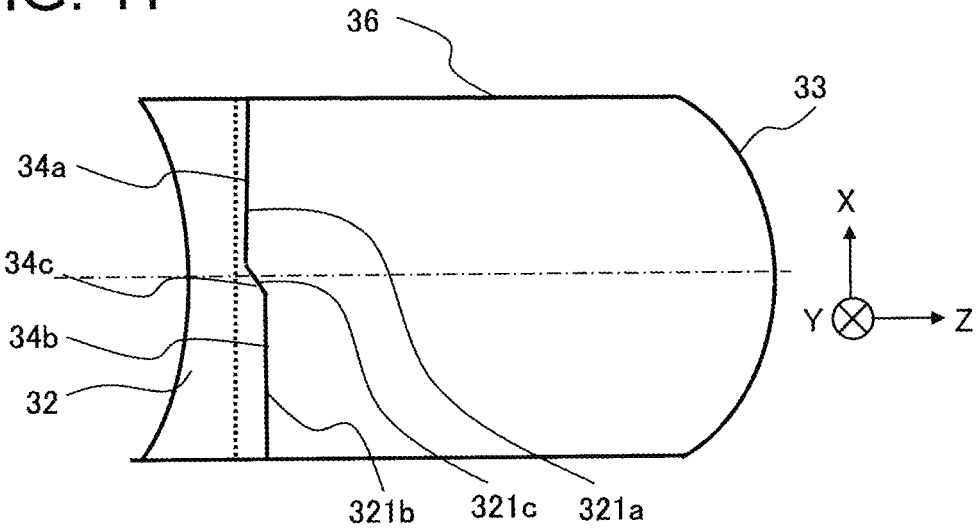
FIG. 11 is a bottom view schematically showing the light guide projection optical element shown in FIG. 8.

As viewed on the ZX plane, as shown in FIG. 2, the light propagating in the light guide projection optical element 30 is condensed at a condensing position inside the light guide projection optical element 30 due to the condensing optical element 20 and the incidence surface 31 of the light guide projection optical element 30. In FIG. 2, the position of the ridge line part 321*b* is the position of the conjugate surface Pc, FIG. 8 is a top view showing principal rays of light passing through a light guide projection optical element 36 of a headlight module 100 according to a modification of the first embodiment. FIG. 9, FIG. 10 and FIG. 11 are a top view, a side view and a bottom view schematically showing the light guide projection optical element 36 shown in FIG. 8. In the headlight module 100 shown in FIG. 8, the curved surface of the incidence surface 31 of the light guide projection optical element. 36 in regard to the horizontal direction (i.e., the X-axis direction) is formed as a concave surface having negative power, for example. With this configuration, the light can be widened in the horizontal direction by the ridge line part 321.

Namely, the width of the light flux on the conjugate surface Pc becomes greater than the width of the light flux on the incidence surface 31. The incidence surface 31 as the concave surface is capable of controlling the width of the light flux on the conjugate surface Pc in the X-axis direction. Then, a light distribution pattern that is wide in the horizontal direction can be obtained on the illuminated surface 90.

<Behavior of Light Beam on YZ Plane>

Meanwhile, when the light entering the light guide projection optical element 30 through the incidence surface 31 is viewed on the YZ plane, the light refracted by the incidence surface 31 propagates in the light guide projection optical element 30 and is guided to the reflecting surface 32.

The light entering the light guide projection optical element 30 and reaching the reflecting surface 32 directly reaches the reflecting surface 32 after entering the light guide projection optical element 30. To "directly reach" means to reach without being reflected by another surface or the like. The light entering the light guide projection optical element 30 and reaching the reflecting surface 32 reaches the reflecting surface 32 without being reflected by another surface or the like. Namely, the light reaching the reflecting surface 32 undergoes the first reflection in the light guide projection optical element 30.

Further, the light reflected by the reflecting surface 32 directly emerges from the exit surface 33. Namely, the light reflected by the reflecting surface 32 reaches the exit surface 33 without being reflected by another surface or the like. Thus, the light undergoing the first reflection at the reflecting surface 32 reaches the exit surface 33 due to the single reflection.

In FIGS. 1 to 6, light emitted from parts of the exit surfaces 231 and 232 of the condensing optical element 20 on the $+Y_1$-axis side of the optical axis C2 of the condensing optical element 20 is lead to the reflecting surface 32. Meanwhile, light emitted from parts of the exit surfaces 231 and 232 of the condensing optical element 20 on the $-Y_1$ xis side of the optical axis C2 of the condensing optical element 20 is emitted from the exit surface 33 without being reflected by the reflecting surface 32. In short, part of the light entering the light guide projection optical element 30 reaches the reflecting surface 32. The light reaching the reflecting surface 32 is reflected by the reflecting surface 32 and is emitted from the exit surface 33.

Incidentally, depending on the setting of the inclination angle $\alpha$ of the light source 10 and the condensing optical element 20, it is possible to have all of the light from the condensing optical element 20 reflected by the reflecting surface 32.

Further, depending on the setting of the inclination angle $\beta$ of the reflecting surface 32, it is possible to have all of the light from the condensing optical element 20 reflected by the reflecting surface 32.

Depending on the setting of the inclination angle $\alpha$ of the light source 10 and the condensing optical element 20, the length of the light guide projection optical element 30 in the optical axis C1 direction (i.e., the Z-axis direction) can be shortened. Then, the depth (i.e., length in the Z-axis direction) of the optical system can be shortened. Here, the "optical system" in the first embodiment means an optical system including the condensing optical element 20 and the light guide projection optical element 30 as its components.

Depending on the setting of the inclination angle $\alpha$ of the light source 10 and the condensing optical element 20, it becomes easy to guide the light emerging from the condensing optical element 20 to the reflecting surface 32. This makes it easy to efficiently collect light into a region on the conjugate surface Pc and inside (i.e., on the +Y-axis side of) the ridge line part 321. Specifically, by collecting the light emerging from the condensing optical element 20 onto the conjugate surface Pc's side of the reflecting surface 32, the amount of light emitted from the region on the +Y-axis direction side of the ridge line part 321 can be increased.

Accordingly, it becomes easy to brighten the region of the light distribution pattern projected on the illuminated surface 90 on the lower side of the cutoff line 91. Further, thanks to the shortening of the length of the light guide projection optical element 30 in the optical axis direction (i.e., the Z-axis direction), internal absorption of light in the light guide projection optical element 30 decreases and the light utilization efficiency increases. The "internal absorption" means the optical loss inside a material when light passes through light guide component (e.g., the light guide projection optical element 30), excluding a loss due to surface reflection. The internal absorption increases with the increase in the length of the light guide component.

In an ordinary type of light guide element, light travels inside the light guide element while being repeatedly reflected by side faces of the light guide element. Accordingly, intensity distribution of the light is uniformalized. In the first embodiment, the light entering the light guide projection optical element 30 is reflected once by the reflecting surface 32 and is emitted from the exit surface 33. In this regard, the usage of the light guide projection optical element 30 in the first embodiment differs from the usage of the ordinary type of light guide element.

In the light distribution pattern stipulated by the road traffic rules or the like, the region on the lower side (i.e., the −Y-axis side) of the cutoff line 91 is the region of the maximum illuminance, for example. As mentioned earlier, the ridge line part 321 of the light guide projection optical element 30 is in the conjugate relationship with the illuminated surface 90. Thus, in order to let the region on the lower side (i.e., the −Y-axis side) of the cutoff line 91 have the maximum illuminance, it is sufficient. If the luminosity of a region of the light guide projection optical element 30 on the upper side (i.e., the +Y-axis side) of the ridge line part 321 is made to be the highest.

In order to generate such a light distribution pattern in which the region on the lower side (i.e., the −Y-axis side) of the cutoff line 91 has the maximum illuminance, it is effective, as shown in FIG. 1, to make the reflecting surface 2 reflect part of the light entering the light guide projection opt cal element 30 through the incidence surface 31 as viewed on the YZ plane. This is because a part of the entered light entering the light guide projection optical element 30 through the incidence surface 31 that reaches the +Y-axis side of the ridge line part 321 without being reflected by the reflecting surface 32 and a part of the entered light that is reflected by the reflecting surface 32 are superimposed on each other on the conjugate surface Pc.

Namely, in the region on the conjugate surface Pc corresponding to the high illuminance region on the illuminated surface 90, the light reaching the conjugate surface Pc without being reflected by the reflecting surface 32 and the light reaching the conjugate surface Pc after being reflected by the reflecting surface 32 are superimposed on each other, With such a configuration, the luminosity of the region on the upper side (i.e., the +Y-axis side) of the ridge line part 321 can be made to be the highest in the luminosity on the conjugate surface Pc.

The region at high luminosity is formed by superimposing the light reaching the conjugate surface Pc without being reflected by the reflecting surface 32 and the light reaching the conjugate surface Pc after being reflected by the reflecting surface 32 on each other on the conjugate surface Pc.

Modification of the position of the high luminosity region on the conjugate surface Pc is possible by changing the light-reflecting position on the reflecting surface 32.

By making the light-reflecting position on the reflecting surface 32 close to the conjugate surface Pc, a region on the conjugate surface Pc and close to the ridge line part 321 can be made to be the high luminosity region. Namely, the region on the illuminated surface 90 on the lower side of the cutoff line 91 can be made to be the high illuminance region.

Further, the amount of the superimposed light can be adjusted by setting the curvature of the incidence surface 31 in the vertical direction (i.e., the Y-axis direction) at a desirable value, similarly to the adjustment of the light distribution width in the horizontal direction. The "amount of the superimposed light" means the amount of the light as the result of the superimposition of the light reaching the +Y-axis side of the ridge line part 321 (on the conjugate surface Pc) without being reflected by the reflecting surface 32 and the light reflected by the reflecting surface 32.

As above, the light distribution can be adjusted by adjusting the curvature of the incidence surface 31. In other words, a desired light distribution can be obtained by appropriately setting the curvature of the incidence surface 31. Here, the "desired light distribution" means the light distribution stipulated by the road traffic rules or the like, for example. In cases where one light distribution pattern is formed by using a plurality of headlight modules 100 as shown in FIG. 24 which will be explained later, the "desired light distribution" means light distribution required of each of the plurality of headlight modules 100.

Further, the desired light distribution can be obtained by adjusting a geometrical relationship between the condensing optical element 20 and the light guide projection optical element 30. Namely, the desired light distribution can be obtained by appropriately setting the geometrical relationship between the condensing optical element 20 and the light guide projection optical element 30. Here, the "desired light distribution" means the light distribution stipulated by the road traffic rules or the like, for example.

The "geometrical relationship" means a positional relationship between the condensing optical element 20 and the light guide projection optical element 30 in the optical axis direction, for example. With the decrease in the distance from the condensing optical element 20 to the light guide projection optical element 30, the amount of light reflected by the reflecting surface 32 decreases and the dimension of the light distribution pattern in the vertical direction (i.e., the Y-axis direction) decreases. Namely, the height of the light distribution pattern decreases. Conversely, with the increase in the distance from the condensing optical element 20 to the light guide projection optical element 30, the amount of light reflected by the reflecting surface 32 increases and the dimension of the light distribution in the vertical direction (i.e., the Y-axis direction) increases. Namely, the height of the light distribution pattern increases.

Furthermore, the position of the superimposed light can be changed by adjusting the position of the light reflected by the reflecting surface 32. The "position of the superimposed light" means the position where the light reaching the +Y-axis side of the ridge line part 321 (on the conjugate surface Pc) without being reflected by the reflecting surface 32 and the light reflected by the reflecting surface 32 are superimposed on each other on the conjugate surface Pc. Thus, the "position of the superimposed light" means the range of the high luminosity region on the conjugate surface Pc. The high luminosity region is the region on the conjugate surface Pc corresponding to the high illuminance region on the illuminated surface 90.

Moreover, the height of the high luminosity region on the exit surface 33 can be adjusted by adjusting the condensing position of the light reflected by the reflecting surface 32. Specifically, when the condensing position is close to the conjugate surface Pc, the dimension of the high luminosity region in the height direction becomes short. Conversely, when the condensing position is far from the conjugate surface Pc, the dimension of the high luminosity region in the height direction becomes long.

Incidentally, the high illuminance region is the region on the lower side (i.e., the −Y-axis side) of the cutoff line 91. Namely, this region represents the position of the high illuminance region of the light distribution pattern on the illuminated surface 90.

For example, there are cases where one light ibution pattern is formed on the illuminated surface 90 by using a plurality of headlight modules. In such cases, the high luminosity region of each headlight module on the conjugate surface Pc is not limited to the region on the +Y-axis side of the ridge line part 321. On the conjugate surface Pc, the high luminosity region is formed at a position suitable for the light distribution pattern of each headlight module.

The width of the light distribution pattern can be controlled by adjusting the condensing position regarding the horizontal direction. Further, the height of the high illuminance region can be controlled by adjusting the condensing position regarding the vertical direction. As above, the condensing position regarding the horizontal direction and the condensing position regarding the vertical direction do not necessarily have to coincide with each other. The shape of the light distribution pattern or the shape of the high illuminance region can be set in a desired shape by independently setting the condensing position regarding the horizontal direction and the condensing position regarding the vertical direction.

Further, a cutoff line in a shape having a step can be formed with ease by setting the shape of the ridge line part 321 of the reflecting surface 32 in a bent line shape varying in the position in the Z-axis direction. According to the first embodiment, differently from a comparative example (shown in FIG. 14 and FIG. 15 which will be explained later) having a step on the reflecting surface of the light guide projection optical element, there is no shape connecting steps (different levels) on the reflecting surface 32 (e.g., inclined surface 32*c* shown in FIG. 14), and thus the light distribution irregularity can be reduced.

The image of the light distribution pattern formed on the conjugate surface Pc is magnified and projected by the light guide projection optical element 30 onto the illuminated surface 90 in the forward direction from the vehicle. The position of the focal point of the exit surface 33 in the 2-axis direction (i.e., the optical axis C1 direction) coincides with the position of the ridge line part 321*b* in the 2-axis direction.

In conventional headlight devices, there are cases where the cutoff line is formed by using a plurality of components such as a light blocking plate and a projection lens. However, in the first embodiment, the light guide projection optical element 30 is formed with one component, and thus the focal position of the exit surface 33 can be made to coincide with the position of the ridge line part 321*a* in the optical axis C1 direction. Accordingly, the headlight module 100 is capable of inhibiting changes such as deformation of the cutoff line or variations in the light distribution. This is because improving the shape accuracy of one component is generally easier than improving the positional accuracy between two components.

<Light Distribution Pattern>

In the light distribution pattern of the low beam of a headlight device for an automobile, the cutoff line 91 is in the stepped shape including the rising line. The conjugate surface Pc of the light guide projection optical element 30 and the illuminated surface 90 are in the optically conjugate relationship. The ridge line part 321*a* is situated at the lowest end (i.e., on the −Y-axis side) of the region on the conjugate surface Pc through which the light passes. The ridge line part 321 corresponds to the cutoff line 91 on the illuminated surface 90.

The headlight module 100 according to the first embodiment projects the light distribution pattern formed on the conjugate surface Pc directly onto the illuminated surface 90. Thus, the Lighting distribution on the conjugate surface Pc is projected onto the illuminated surface 90 without change. Therefore, in order to realize a light distribution pattern with less light distribution irregularity, it is effective to reduce the light distribution irregularity on the conjugate surface Pc. Further, the shape of the ridge line part 321 is projected onto the illuminated surface 90.

Incidentally, while the above description has been given on the assumption that be position of the conjugate surface Pc is the position of the ridge line part 321*b*, the position of the conjugate surface Pc may vary in the optical axis direction (i.e., the Z-axis direction) from the position of the ridge line part 321*b*. For example, the position of the conjugate surface Pc can be adjusted within ±1.0 mm of the ridge line part 321*b* in the optical axis direction (i.e., the Z-axis direction) as the vicinity of the ridge line part 321*b*. Incidentally, besides the vicinity defined as being within ±1.0 mm, the vicinity may also be defined as being within the focal depth of the exit surface 33.

In cases where the position of the conjugate surface Pc is at the position of the ridge line part 321*b*, the cutoff line 91 projected on the illuminated surface 90 is distinct with no blurring. However, when the cutoff line 91 is too distinct, a feeling of strangeness might be given to the driver since the brightness difference across the cutoff line 91 as the boundary is great. In such cases, the driver's feeling of strangeness can be eliminated by shifting the position of the conjugate surface Pc from the ridge line part 321*b* in the optical axis direction to blur the cutoff line 91.

Figure 12:
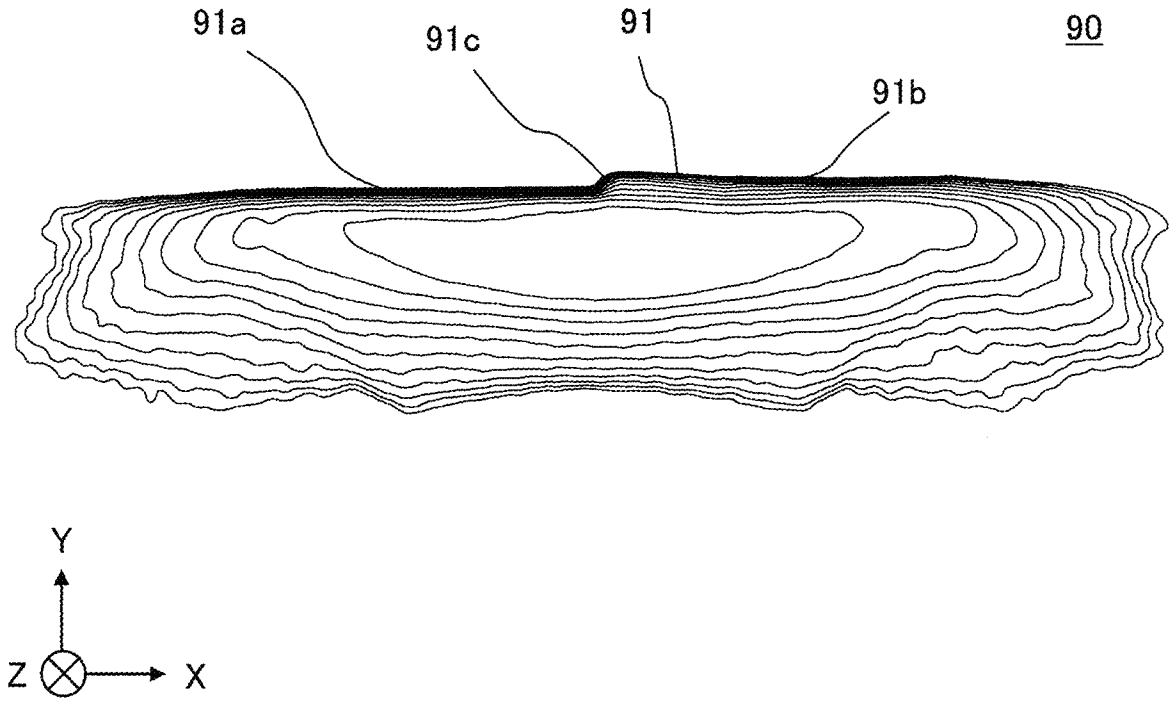
FIG. 12 is a diagram showing illuminance distribution of illuminating light projected by the headlight module according to the first embodiment in contour display.
Figure 13:
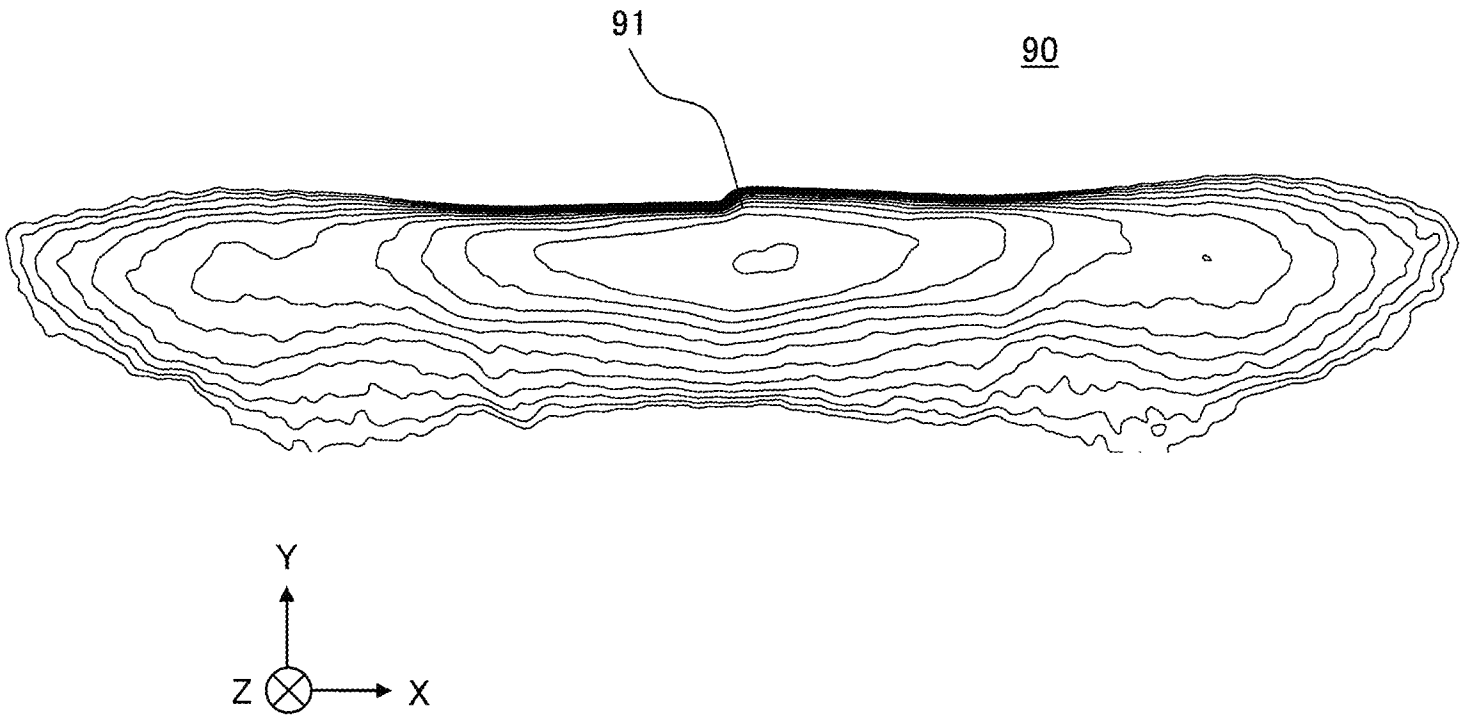
FIG. 13 is a diagram showing the illuminance distribution of the illuminating light projected by the headlight module according to the first embodiment in the contour display.

FIG. 12 and FIG. 13 are diagrams showing the illuminance distribution of the headlight module 100 according to the first embodiment in contour display. FIG. 12 shows the illuminance distribution in a case where the light guide projection optical element 30 shown in FIG. 3 to FIG. 6 is used. FIG. 13 shows the illuminance distribution in a case where the light guide projection optical element. 36 shown in FIG. 8 to FIG. 11 is used. This illuminance distribution is illuminance distribution of light projected on the illuminated surface 90 that is 25 meters ahead (i.e., in the +Z-axis direction). This illuminance distribution is obtained by simulation. The "contour display" means displaying in a contour drawing. The "contour drawing" means a drawing in which points having the same value are connected by lines.

As is clear from FIG. 12, the cutoff line 91 of the light distribution pattern is projected distinctly. Further, a light distribution pattern with no light distribution irregularity is realized. The cutoff lines 91*a*, 91*b* and 91*c* shown in FIG. 12 respectively correspond to the ridge Line parts 321*a*, 321*b* and 321*c* of the light guide projection optical element 30 of the headlight module 100 according to the first embodiment.

Figure 14:
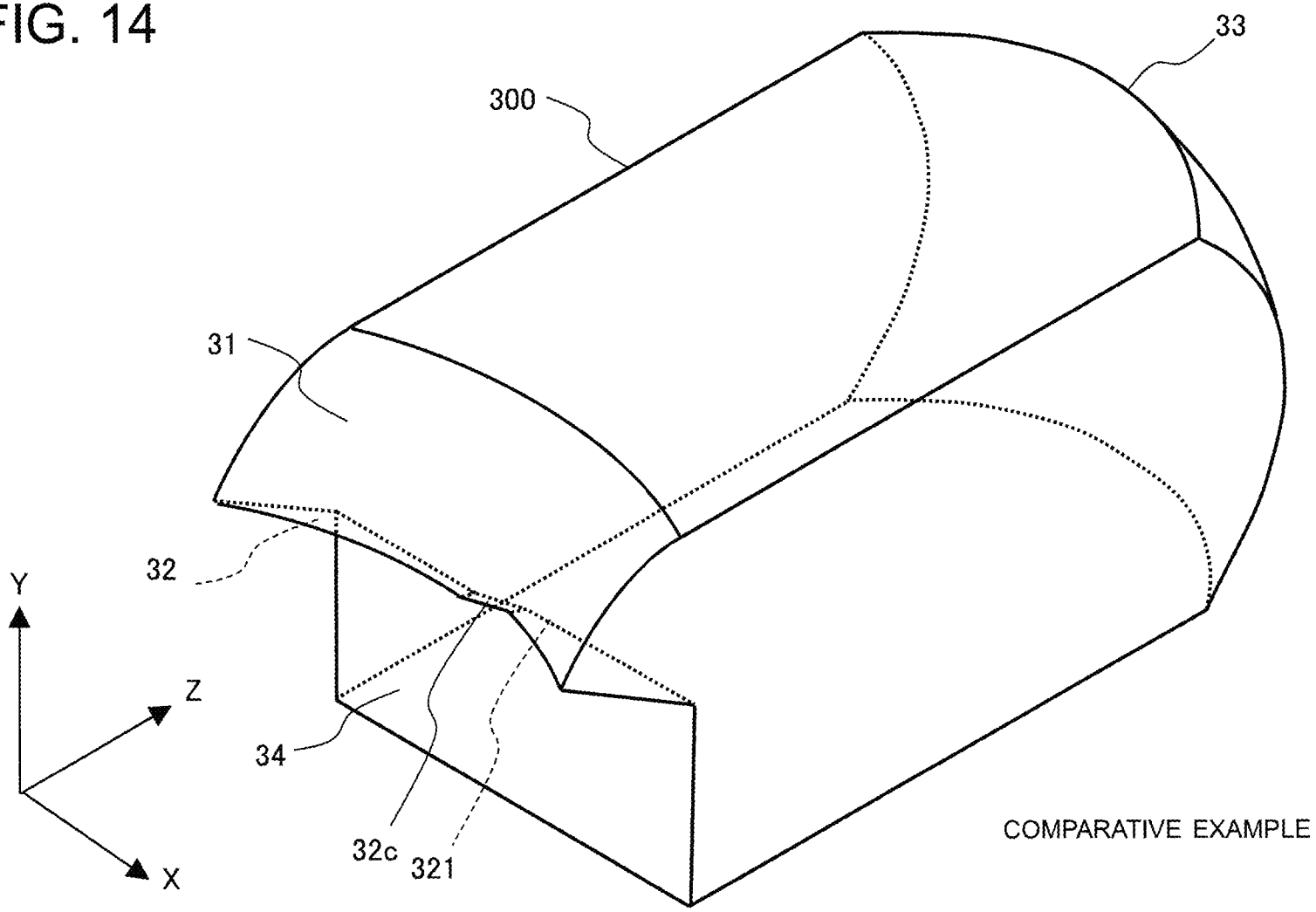
FIG. 14 is a perspective view showing a light guide projection optical element as a comparative example.
Figure 15:
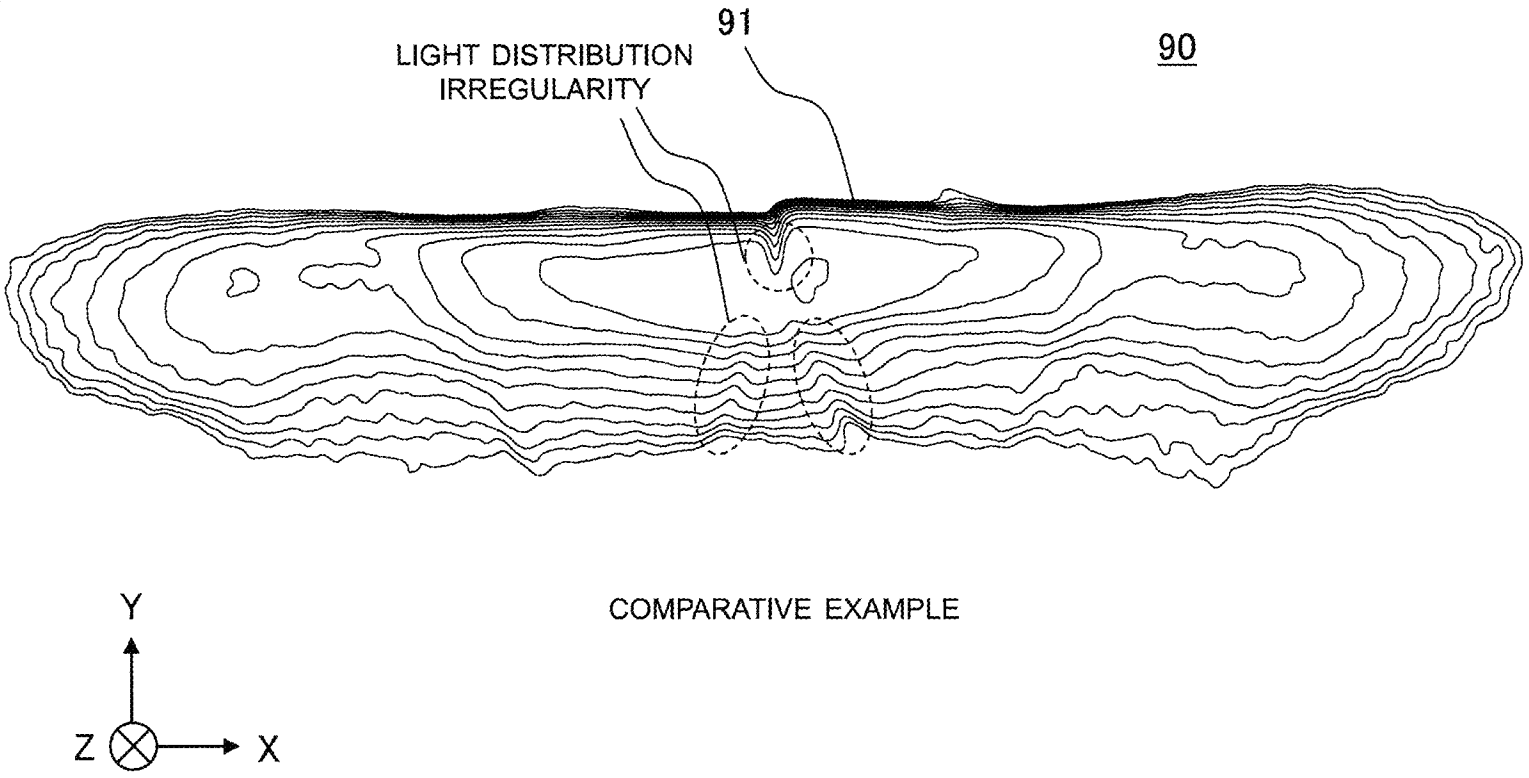
FIG. 15 is a diagram showing the illuminance distribution of the illuminating light projected by a headlight module employing the light guide projection optical element as the comparative example in the contour display.

FIG. 13 is a diagram showing the illuminance distribution of the illuminating light projected by the headlight module 100 according to the modification of the first embodiment in the contour display. The incidence surface 31 has negative power in the horizontal direction FIG. 14 is a perspective view showing a light guide projection optical element 300 as a comparative example. FIG. 15 is a diagram showing the illuminance distribution of the illuminating light projected by a headlight module employing the light guide projection optical element 300 as the comparative example in the contour display. Thus, compared to the light distribution pattern shown in FIG. 12, the light distribution pattern of the comparative example shown in FIG. 15 has a greater width (i.e., width in the X-axis direction) of the light distribution.

Further, the cutoff line 91 of the light distribution pattern shown in FIG. 13 is projected distinctly in comparison with that of the light distribution pattern of the comparative example shown in FIG. 15. Furthermore, a light distribution pattern with no light distribution irregularity is realized.

As above, the light distribution pattern can be formed with ease by changing the curved surface shape of the incidence surface 31 of the light guide projection optical element 30. Thus, the region on the lower side of the cutoff line 91 can be made to be the brightest while maintaining the distinct cutoff line 91.

<Comparison with Comparative Example>

The incidence surface 31 of the light guide projection optical element 300 shown in FIG. 14 is the same as the incidence surface 31 of the light guide projection optical element 30 shown in FIG. 8. The incidence surface 31 of the light guide projection optical element 300 has negative power in the horizontal direction (i.e., the X-axis direction). Namely, the incidence surface 31 is in a concave shape in the horizontal direction (i.e., the X-axis direction). Further, an edge part of the reflecting surface 32 is in a shape having a step to be connected to a step included in the reflecting surface 32. Furthermore, the ridge line part 321 is formed on the same plane as the incidence surface 34.

FIG. 15 shows the illuminance distribution obtained by using the light guide projection optical element 300 shown in FIG. 14 in the contour display. Compared to the light distribution pattern shown in FIG. 13, the light distribution pattern shown in FIG. 15 has significant light distribution irregularity in regions surrounded by broken lines. The "light distribution irregularity" means that the contour lines of the illuminance distribution are not smooth curved lines. Such light distribution irregularity leads to the driver's misrecognition of distance, overlooking of obstacles, or the like. Thus, the safety performance of the headlight device deteriorates.

Specifically, the headlight device as the comparative example forms the cutoff line 91 by providing the reflecting surface 32 with a step varying in the position in the height direction (i.e., a step whose XY cross-sectional shape is a bent line shape), for example. In the case of such a comparative example, light reflected by an inclined surface connecting steps (different levels) of the reflecting surface travels in a direction different from the traveling direction in a case where the reflecting surface includes no step. Accordingly, the light distribution irregularity occurs as shown in FIG. 15 with the headlight device as the comparative example.

The headlight module 100 according to the first embodiment does not need to provide the reflecting surface 32 with a step as in the headlight device as the comparative example in order to generate the cutoff line 91. Accordingly, the headlight module 100 is capable of reducing the occurrence of the light distribution irregularity with a simple configuration.

The headlight module 100 according to the first embodiment has been described above by taking an example of the low beam of a headlight device for automobiles. However, the headlight module 100 is not limited to a headlight device for automobiles. For example, the headlight module 100 may be employed as a headlight device for motorcycles or motor tricycles. Further, the headlight module 100 is applicable to the low beam or the high beam of a headlight device.

There are vehicles on which a plurality of headlight modules are arranged to form a light distribution pattern by adding light distribution patterns of the modules together. Namely, there are cases where a plurality of headlight modules are arranged and a light distribution pattern is formed by adding light distribution patterns of the modules together. Even in such cases, the headlight module 100 according to the first embodiment can be employed with ease.

With the headlight module 100, the width and the height of the light distribution pattern can be changed by adjusting the curved surface shape of the incidence surface 31 of the light guide projection optical element 30. Consequently, the lighting distribution can also be changed.

Further, with the headlight module 100, the width and the height of the light distribution pattern can be changed by adjusting the optical positional relationship between the condensing optical element 20 and the light guide projection optical element 30 or the shape of the incidence surface 31 of the light guide projection optical element 30. Consequently, the lighting distribution can also be changed.

Furthermore, the changing of the lighting distribution can also be facilitated by use of the reflecting surface 32. For example, the position of the high illuminance region can be changed by changing the inclination angle β of the reflecting surface 32. Further, for example, the luminance gradient between the cutoff line and the high illuminance region can be changed by changing the inclination angle β of the reflecting surface 32, The inclination angle β of the reflecting surface 32 is desired to be greater than or equal to 0 degrees and less than +45 degrees, for example. Incidentally, it is more desirable that the inclination angle β of the reflecting surface 32 be greater than or equal to 0 degrees and less than +30 degrees.

Here, the inclination angle β is an angle (i.e., angle with respect to the ZX plane) of a vector as a component, parallel to the Z-axis, of a vector indicating the inclination of a tangent plane to the reflecting surface 32 with respect to the ZX lane. Incidentally, in a case where the reflecting surface 32 is in a shape other than a plane (e.g., a curved surface shape or a multifaceted shape), the inclination angle β may be obtained as an angle (i.e., angle with respect to the ZX plane) indicated by a component, parallel to the Z-axis, of a direction represented by the sum total of inclination vectors of tangent planes obtained in the whole region of the reflecting surface 32. Parenthetically, it is also possible to use the region on which the light from the light source is incident (i.e., effective region), instead of the whole region of the reflecting surface 32, as the range for obtaining the sum total.

The inclination angle β can also take on a negative value. The inclination angle β is assumed to be 0 degrees when the reflecting surface 32 is parallel to the ZX plane, a positive angle when the reflecting surface 32 has a downward inclination with respect to the traveling direction of the light, that is, when the ridge line part 321 as an end of the reflecting surface 32 in the +Z-axis direction is situated on the −Y-axis side compared with an end of the reflecting surface 32 in the −Z-axis direction, and a negative angle when the reflecting surface 32 has an upward inclination with respect to the traveling direction of the light, that is, when the ridge line part 321 as the end of the reflecting surface 32 in the +2-axis direction is situated on the +Y-axis side compared with the end of the reflecting surface 32 in the −Z-axis direction.

The lower limit of the inclination angle β is −90 degrees, for example. In other words, the inclination angle β is desired to be greater than or equal to −90 degrees. It is more desirable that the inclination angle β be greater than or equal to −45 degrees.

Figure 16:
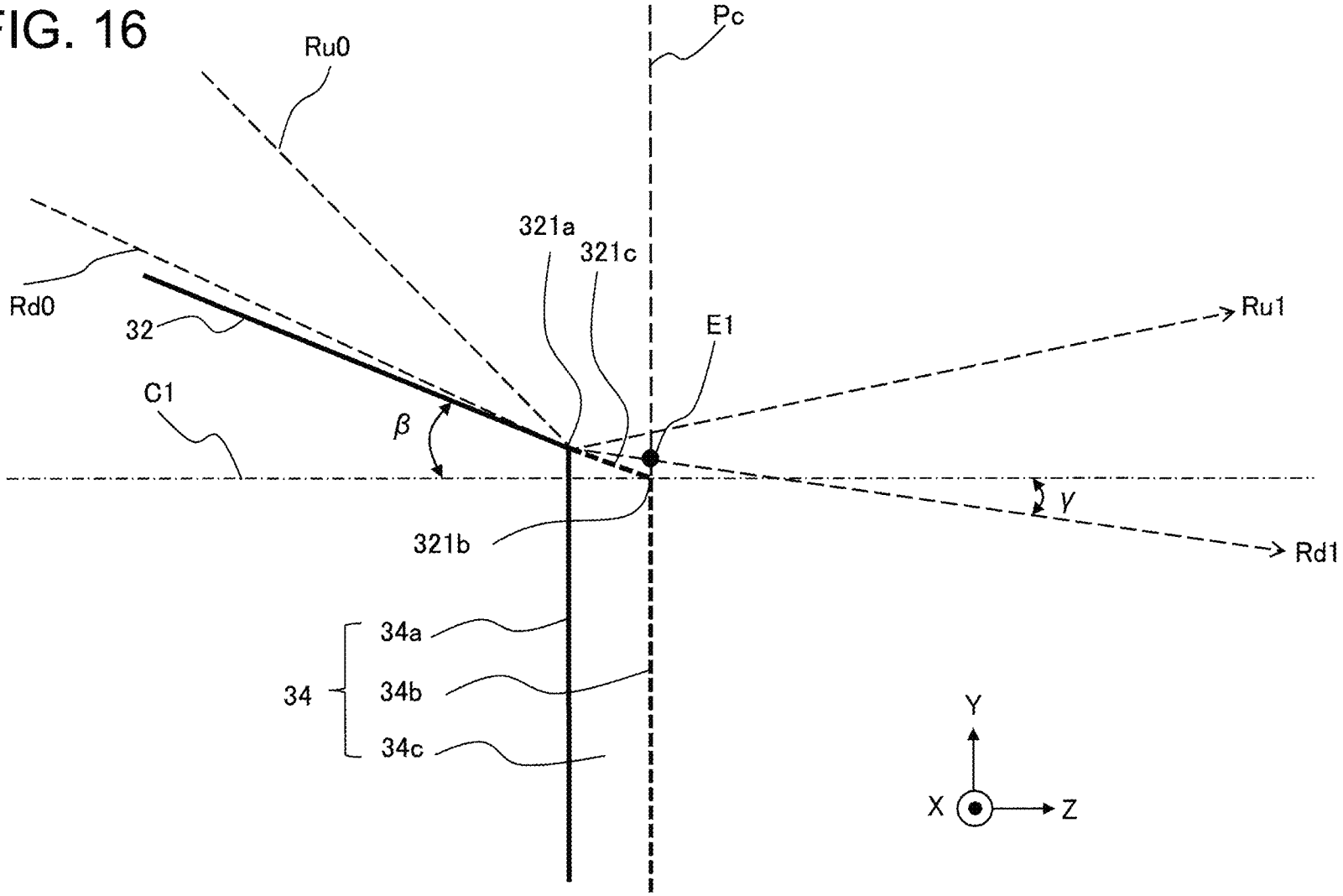
FIG. 16 is a diagram for explaining a relationship between an inclination angle of a reflecting surface of the headlight module according to the first embodiment and the light distribution pattern formed on a conjugate surface.

FIG. 16 is a diagram for explaining the relationship between the inclination angle of the reflecting surface of the headlight module 100 according to the first embodiment and the light distribution pattern formed on the conjugate surface. FIG. 16 magnifies the ridge line part 321 of the light guide projection optical element 30 of the headlight module 100. In FIG. 16, the inclination angle β of the reflecting surface 32 is 20 degrees. Among rays of light reflected by the ridge line part 321*a* of the reflecting surface 32, a ray as the result of reflection of a ray Rd0 that is incident on the reflecting surface 32 from the most −Y-axis side is represented as a ray Rd1, and a ray as the result of reflection of a ray Ru0 that is incident on the reflecting surface 32 from the most +Y-axis side is represented as a ray Ru1.

The exit surface 33 of the light guide projection optical element 30 projects the light distribution pattern formed on the conjugate surface Pc. Specifically, the exit surface 33 projects a position E1 as a point where the ray Rd1, reflected by the ridge line part 321*a* after being incident on the ridge line part 321*a* from the most −Y-axis side among the rays of light reflected by the ridge line part 321*a*, passes through the conjugate surface Pc. In this case, an angle γ formed by the ray Rd1 and the optical axis C1 is smaller than the inclination angle β of the reflecting surface 32. In the case of FIG. 16, the angle γ is less than 20 degrees. In order to facilitate the understanding, the angle γ may be regarded as an angle as ½ of a spread angle of an outgoing light flux surrounded by the ray Ru1 and the ray Rd1.

With the in ase in the angle γ formed by the ray Rd1 and the optical axis C1, aberration on the light distribution pattern projected by the exit surface 33 increases. Here, the aberration means the amount of blurring on the light distribution pattern occurring due to the difference between the degree of spreading of light when light reflected by the ridge line part 321*a* passes through the conjugate surface Pc (which can be practically regarded as a point even though having a width dependent on the focal depth) in a case where the conjugate surface Pc is provisionally set at the position of the ridge line part 321*a* and the degree of spreading of light when the light reflected by the ridge line part 321*a* passes through the conjugate surface Pc (having a width corresponding to the spread angle of the outgoing light flux surrounded by the ray Ru1 and the ray Rd1) in a case where the conjugate surface Pc is set at the position of the ridge line part 321*b*. Thus, with the increase in the angle γ, the degree of spreading of light when passing through the conjugate surface Pc increases and thus the blurring occurs to the cutoff line 91*a* corresponding to the ridge line part 321*a*. Therefore, to prevent the occurrence of major blurring to the cutoff line 91*a*, it is desirable to appropriately set the angle of the reflecting ace 32.

To hold down the blurring of the cutoff line 91 within a range permissible for the headlight module 100, the angle γ formed the ray Rd1 and the optical axis C1 is desired to be less than 45 degrees. Thus, the inclination angle β of the reflecting surface 32 is desired to be set less than 45 degrees. Incidentally, it is more desirable that the angle γ be less than or equal to 30 degrees. Thus, it is more desirable that the inclination angle β of the reflecting surface 32 be set less than 30 degrees.

Further, with the headlight module 100, the shape of the cutoff line 91 can be defined by the shape (i.e., shape as viewed on the ZX plane) of the ridge line part 321 of the light guide projection optical element 30. Namely, the light distribution pattern can be formed in a desired shape by the shape of the light guide projection optical element 30.

In cases where the cutoff line 91 having a step is formed by the ridge line part 321, the ridge line part 321 is divided into two or more parts. In the light guide projection optical element 30 shown in FIG. 1 to FIG. 6, the ridge line part 321 includes the ridge line part 321*a* and the ridge line part 321*b*. The ridge line part 321*a* and the ridge line part 321*b* are arranged at different positions in the optical axis direction. With this configuration, the shape of the cutoff line 91 having a step is formed.

Thus, in a headlight device including a plurality of headlight modules 100, the shape and the like of the condensing optical element 20 can be uniformalized among the headlight modules 100. Namely, the condensing optical element 20 can be used as a common component. Accordingly, the number of types of components can be reduced, the assembling efficiency can be improved, and the production cost can be reduced.

If is sufficient if such functions of adjusting the width and the height of the light distribution pattern and adjusting the lighting distribution are delivered by the whole of the headlight module 100. Optical components of the headlight module 100 include the condensing optical element 20 and the light guide projection optical element 30, Thus, it is also possible to allot these functions to a certain optical surface of either of the condensing optical element. 20 and the light guide projection optical element 30 forming the headlight module 100. For example, it is possible to form the light distribution by forming the reflecting surface 32 of the light guide projection optical element 30 in a curved surface shape to have power.

However, in regard to the reflecting surface 32, not all of the light is necessarily required to reach the reflecting surface 32. Accordingly, the amount of light that can contribute to the formation of the light distribution pattern is limited in the case where a shape is given to the reflecting surface 32. Namely, the amount of light that can give the effect of the shape of the reflecting surface 32 to the light distribution pattern by being reflected by the reflecting surface 32 is limited. Therefore, in order to change the light distribution pattern with ease by giving an optical effect to all of the light, it is desirable to make the incidence surface 31 have power and form the light distribution.

(2) Second Embodiment

In the first embodiment, the description is given of the case where the reflecting surface 32 is a plane as shown in FIG. 1 to FIG. 6. However, the reflecting surface of the headlight module is not limited to a plane but can also be a surface in a curved surface shape (i.e., surface whose cross-sectional shape is a curved line shape) or a multifaceted shape (i.e., surface whose cross-sectional shape is a polygonal shape) formed by connecting a plurality of planes.

Figure 17:
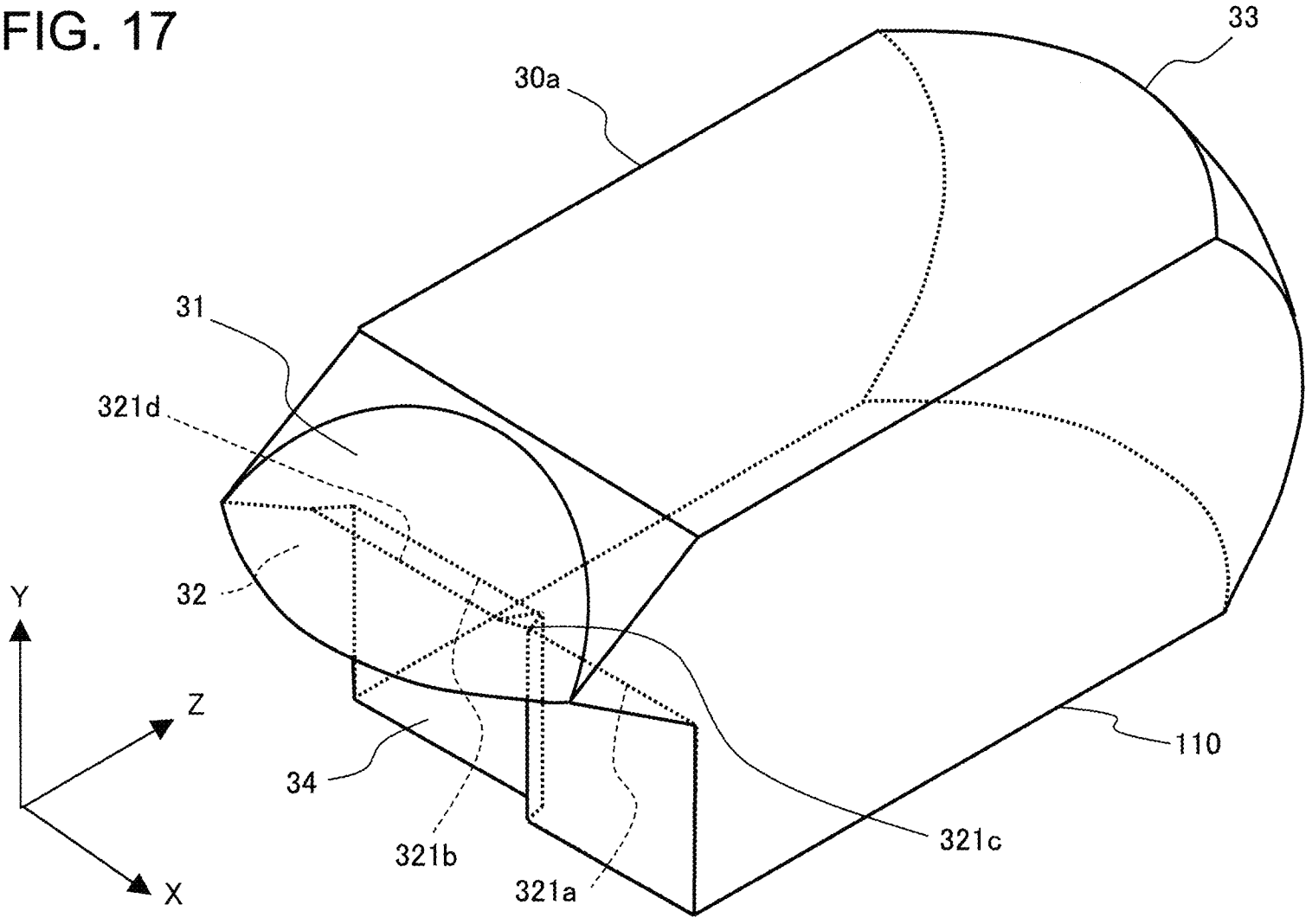
FIG. 17 is a perspective view schematically showing a configuration example of a light guide projection optical element of a headlight module according to a second embodiment of the present invention.
Figure 18:
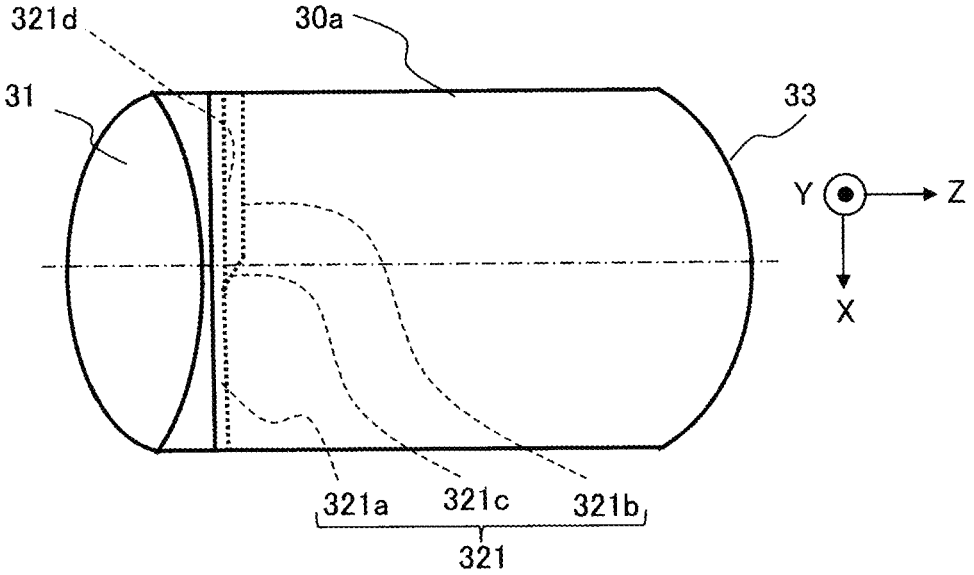
FIG. 18 is a top view schematically showing the light guide projection optical element shown in FIG. 17.
Figure 19:
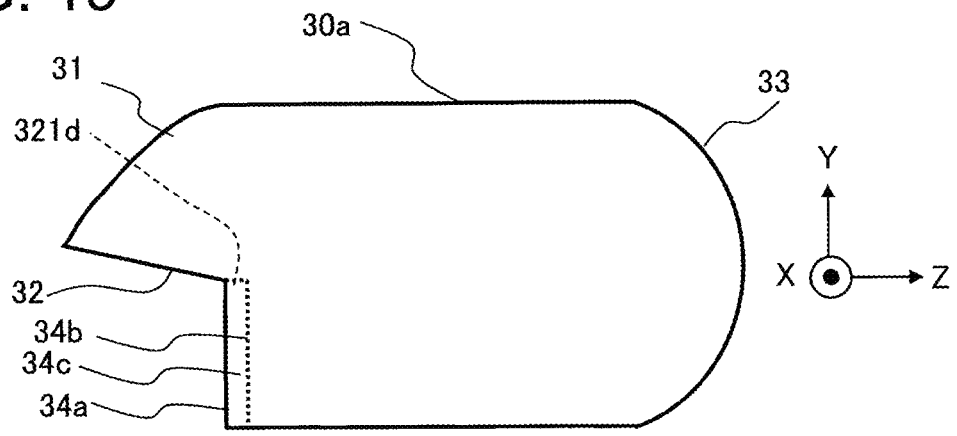
FIG. 19 is a side view schematically showing the light guide projection optical element shown in FIG. 17.
Figure 20:
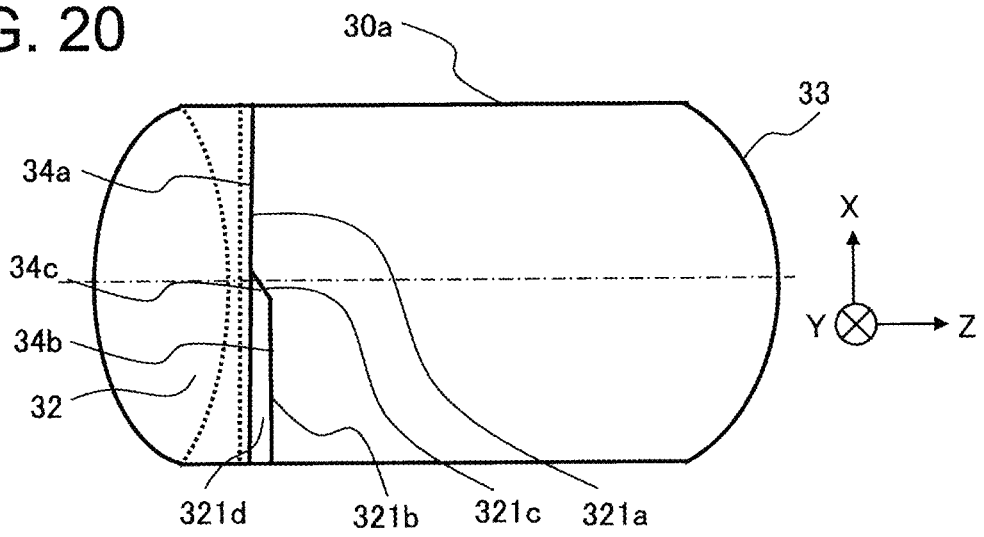
FIG. 20 is a bottom view schematically showing the light guide projection optical element shown in FIG. 17.

FIG. 17 is a perspective view schematically showing a configuration example of a light guide projection optical element 30*a* of a headlight module according to a second embodiment. FIG. 18, FIG. 19 and FIG. 20 are a top view, a side view and a bottom view schematically showing the light guide projection optical element 30*a* shown in FIG. 17. The reflecting surface 32 of the light guide projection optical element 30*a* is in a multifaceted shape. In the second embodiment, the reflecting surface 32 includes a ridge line part 321*d* at a boundary between a first surface on the reflecting surface 32 that is connected to the incidence surface 31 and a second surface that is connected to the ridge line part 321*b*. The ridge line part 321*d* is situated at a position on an extension line from the ridge line part 321*a*. Incidentally, the reflecting surface 32 includes a ridge line part also at a boundary between the first surface on the reflecting surface 32 and a third surface connected to the ridge line part 321*c* and at a boundary between the second surface and the third, surface.

Also in such cases, the reflecting surface 32 has no step in a region (i.e., the aforementioned first surface) other than a region forming the step of the ridge line part 321 (i.e., the aforementioned second surface, third surface and fourth surface in the example shown in FIG. 17). Therefore, the light distribution irregularity of the light distribution pattern can be reduced sufficiently. Here, on the reflecting surface 32, the "region forming the step of the ridge line part 321" means, more specifically, a region of the reflecting surface 32 whose position in the optical axis C1 direction is closer to the exit surface 33 than an edge part of the reflecting surface 32 on the exit surface 33's side (the ridge line part 321*a* in the second embodiment) closest to the incidence surface 31's side.

Except for the above-described features, the second embodiment is the same as the first embodiment.

(3) Third Embodiment

In the above first and second embodiments, the description is given of the case where the headlight module includes one light source 10. However, the headlight module further includes a light source 40 as a second light source. Namely, the headlight module may include two or more light sources.

Figure 21:
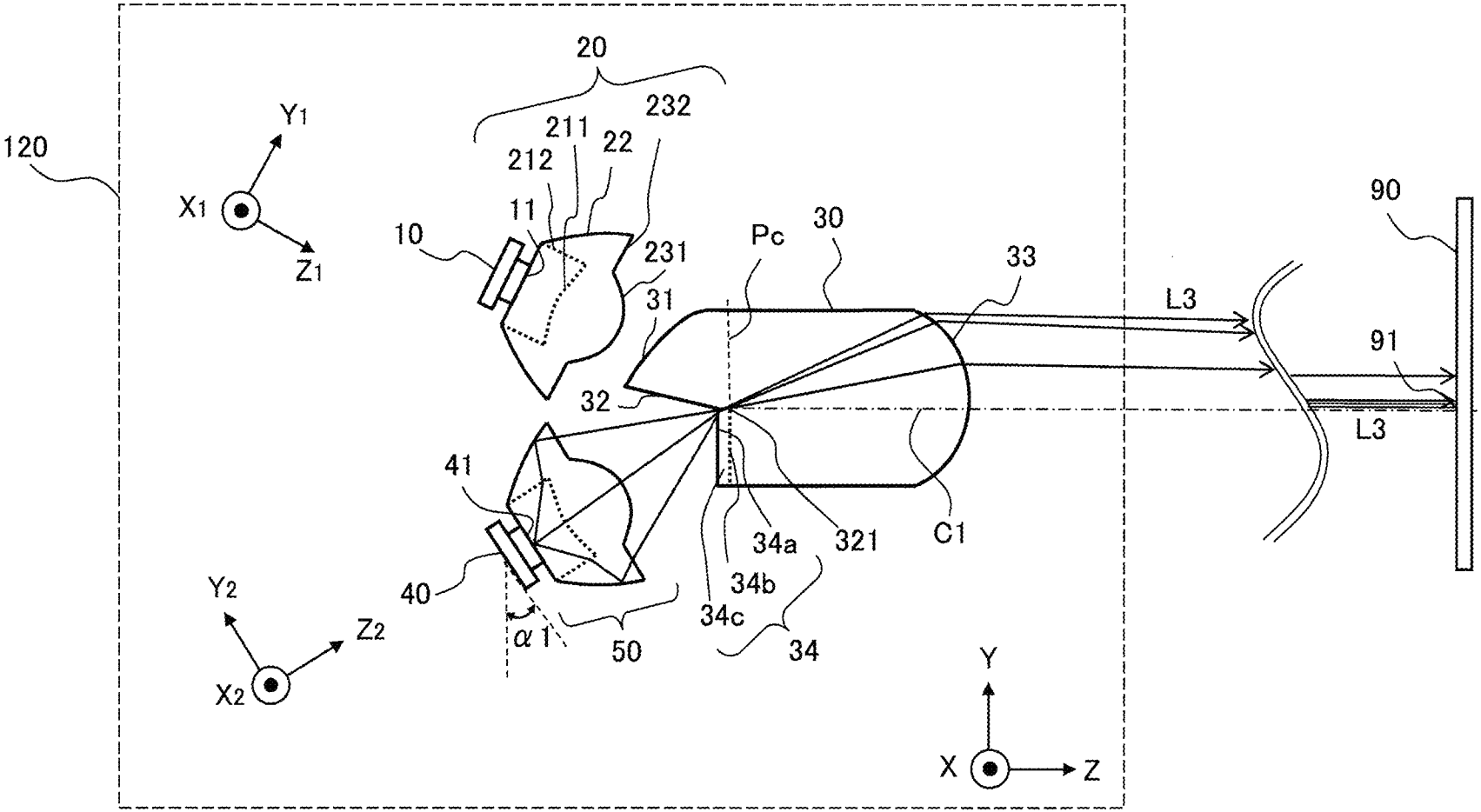
FIG. 21 is a side view schematically showing a configuration example of a headlight module according to a third embodiment of the present invention.

FIG. 21 is a side view schematically showing a configuration example of a headlight module 120 according to a third embodiment. The headlight module 120 according to the third embodiment differs from the headlight module 100 according to the first embodiment in further including the light source 40.

The light source 40 is arranged on the back surface s side of the reflecting surface 32. Light emitted from the light source 40 enters the light guide projection optical element 30 through the incidence surface 34 and is emitted from the exit surface 33. In the headlight module 120, the light emitted from the light source 40 is projected towards a region of the illuminated surface 90 on the upper side of the optical axis C1. Namely, the light source 40 can be used as the light source for the high beam.

Further, as shown in FIG. 21, the headlight module 120 may include a condensing optical element 50 that condenses the light from the light source 40. The condensing optical element 50 has structure similar to the condensing optical element 20. With the condensing optical element 50, the light emitted from the light source 40 can be condensed efficiently.

Except for the above-described features, the third embodiment is the same as the first or second embodiment.

(4) Fourth Embodiment

The description of the headlight module 120 according to the third embodiment is given of the case where the light from the light source 40 enters the light guide projection optical element 30 through the incidence surface 34 and is emitted from the exit surface 33. However, the light guide projection optical element may further include a reflecting surface 35 as a second optical surface that reflects the light emitted from the light source 40.

Figure 22:
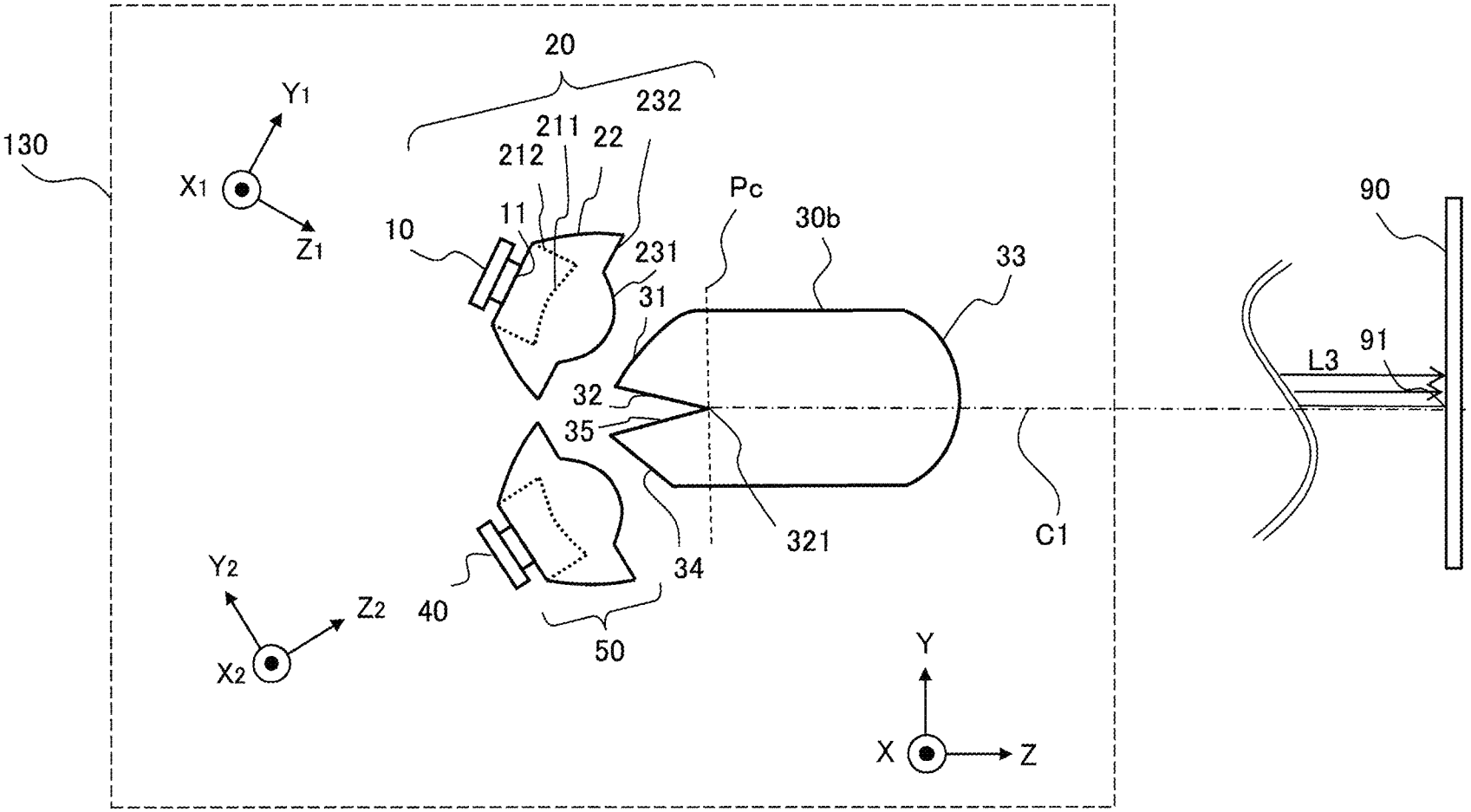
FIG. 22 is a side view schematically showing a configuration example of a headlight module according to a fourth embodiment of the present invention.

FIG. 22 is a side view schematically showing a configuration example of a headlight module 130 according to a fourth embodiment. The headlight module 130 differs from the headlight module 120 according to the third embodiment in including the reflecting surface 35. By using the headlight module 130 according to the fourth embodiment, the light from the light source 40 is incident on the incidence surface 34 of a light guide projection optical element 30*b*, and in the light incident on the incidence surface 34, light reflected by the reflecting surface 35 of the light guide projection optical element 30*b* and light not reflected by the reflecting surface 35 are superimposed on each other at the conjugate surface Pc, which makes it possible to form the high illuminance region. Thus, the headlight module 130 makes it possible to form the high beam including the high illuminance region.

Except for the above-described features, the fourth embodiment is the same as the third embodiment.

(5) Fifth Embodiment

In the first embodiment described earlier, the description is given of the case where the headlight module 100 includes one light source 10. However, the headlight module may include a plurality of light sources aligned in the X-axis direction.

Figure 23:
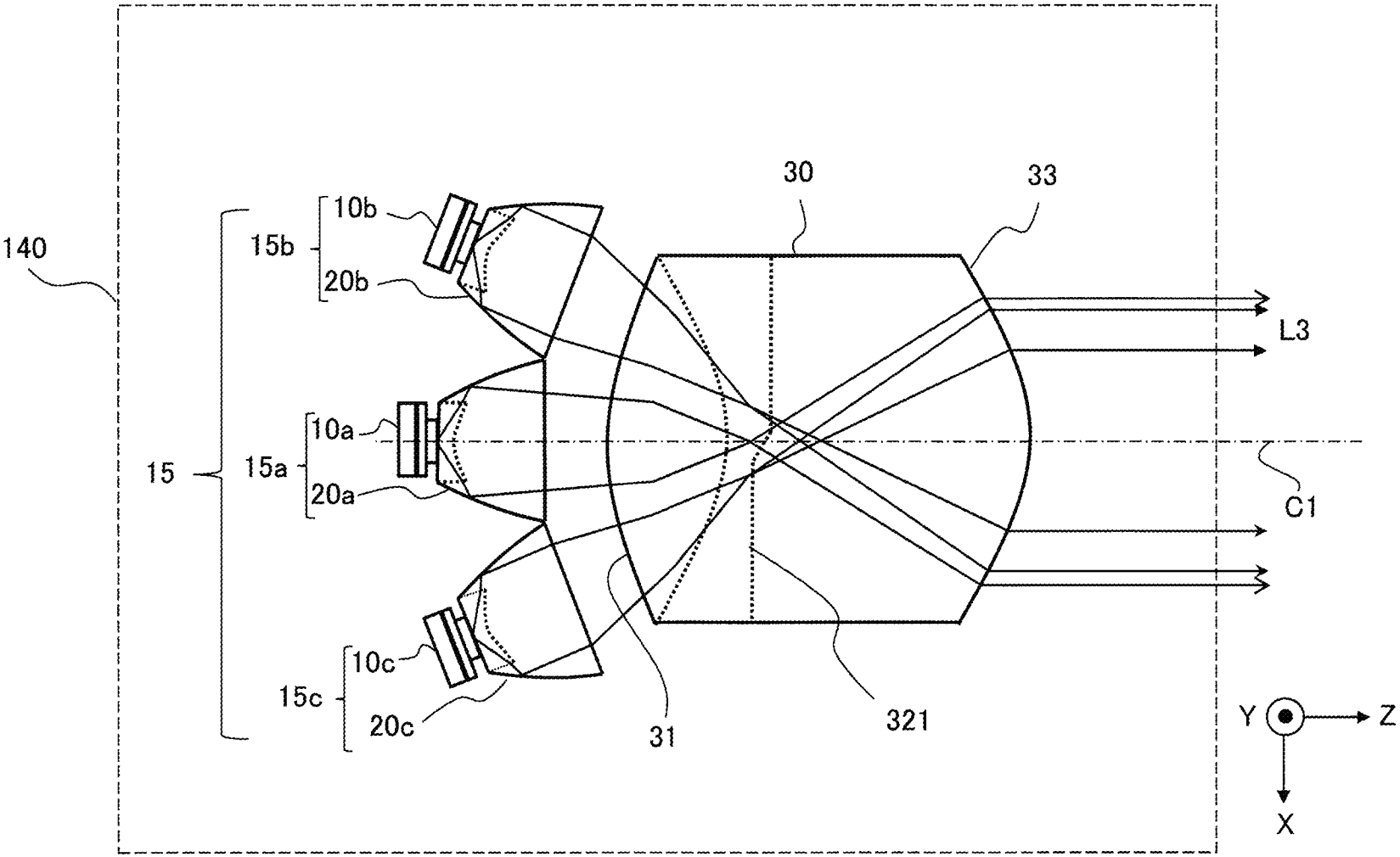
FIG. 23 is a top view schematically showing a configuration example of a headlight module according to a fifth embodiment of the present invention.

FIG. 23 is a top view schematically showing a configuration example of a headlight module 140 according to a fifth embodiment. The headlight module 140 differs from the headlight module 100 in including a light source unit 15 including a plurality of light sources 15*a*, 15*b* and 15*c*. In FIG. 23, the light source unit 15 includes three light sources 15*a*, 15*b* and 15*c*, for example. The light sources 15*b* and 15*c* are arranged symmetrically with respect to the optical axis C1 as viewed on the ZX plane. The light sources 15*a*, 15*b* and 15*c* respectively illuminate different regions.

The light distribution pattern of the low beam is designed so that the vicinity of the center in the horizontal direction is bright. This is because a region in the traveling direction of the vehicle is desired to be illuminated the brightest. However, when the vehicle travels around a curve, the driver drives the vehicle while viewing not the vicinity of the center in the horizontal direction but a peripheral part of the light distribution pattern corresponding to the deepest part of the curve, and thus a problem arises in that sufficient brightness cannot be obtained. In such cases, brightly illuminating a region in the direction of the driver's line of sight becomes possible by independently controlling the lighting of each light source 15*a*, 15*b*, 15*c*. In the case of FIG. 23, the light sources for illuminating the peripheral parts of the light distribution pattern are the light source 15*c* and the light source 15*b*, and brightly illuminating the region in the direction of the driver's line of sight is possible by controlling the lighting of these light sources.

Except for the above-described features, the fifth embodiment is the same as the first embodiment. Further, the headlight module 140 according to the fifth embodiment may be provided with the configuration of any one of the condensing optical elements and the light guide projection optical elements in the first to fourth embodiments.

(6) Sixth Embodiment

In a sixth embodiment, a headlight device 200 employing the headlight modules 100 according to the first embodiment will be described. FIG. 24 is a top view schematically showing a configuration example of the headlight device 200 according to the sixth embodiment.

The headlight device 200 includes a housing 97 and a cover 96. The cover 96 is made of a transparent material. The housing 97 is attached to the inside of the body of the vehicle. The cover 96 is arranged at a superficial part of the vehicle and is exposed to the outside of the vehicle. The cover 96 is arranged on the Z-axis direction side the forward direction side) of the housing 97.

One or more headlight modules 100 are accommodated in the housing 97. In FIG. 24, three headlight modules 100 are accommodated in the housing 97. However, the number of the headlight modules 100 is not limited to three. The number of the headlight modules 100 can also be one, two, or four or more. A plurality of headlight modules 100 are aligned in the X-axis direction inside the housing 97. Incidentally, the way of aligning the plurality of headlight modules 100 is not limited to the alignment in the X-axis direction. It is also possible to arrange the plurality of headlight modules 100 in a different direction such as the Y-axis direction or the Z-axis direction in consideration of design, functionality or the like.

Light emitted from the plurality of headlight modules 100 passes through the cover 96 and is emitted in the forward direction from the vehicle. In FIG. 24, the illuminating light L3 emitted from the cover 96, as a superimposition of light beams emitted from adjoining headlight modules 100, forms one light distribution pattern.

The cover 96 is provided in order to protect the headlight modules 100 from wind, rain, dust and the like. However, it is unnecessary to provide the cover 96 in a case where each headlight module 100 has a configuration in which the light guide projection optical element 30 protects the components in the headlight module 100 from wind, rain, dust and the like. In FIG. 24, the headlight modules 100 are accommodated in the housing 97. However, the housing 97 does not need to be box-shaped. It is also possible to form the housing 97 with a frame or the like and employ a configuration in which the headlight modules 100 are fixed to the frame.

As described above, the headlight device 200 including a plurality of headlight modules 100 is an aggregate of the headlight modules 100. In cases where the headlight device 200 includes one headlight module 100, the headlight device 200 is the same as the headlight module 100. The headlight device 200 according to the sixth embodiment may include the headlight module(s) according to any one of the first to fifth embodiments.

(7) Modification

Components in the first to sixth embodiments described above can be appropriately combined with each other.

In the above-described first to sixth embodiments, terms indicating a positional relationship between components or the shape of a component are intended to include a range allowing for tolerances in the manufacture, variations in the assembly, or the like.

DESCRIPTION OF REFERENCE CHARACTERS

10, 10*a*-10*c*, 40: light source, 11: light-emitting surface, 20, 20*a*-20*c*, 50: condensing optical element, 211, 212: incidence surface, 22 reflecting surface, 231, 232: exit surface, 30, 30*a*, 30*b*, 36: light guide protection optical element, 31, 34: incidence surface, 32: reflecting surface, 321, 321*a*, 321*b*, 321*c*: ridge line part, 33: exit surface, 90: illuminated surface, 91: cutoff line, 96: cover, 97: housing, 100, 120, 130, 140: headlight module, 200: headlight device, α, β, γ: angle, C1, C2: optical axis, L3: illuminating light, Pc: conjugate surface.

What is claimed is:

1. A headlight module comprising:

a first light source that emits first light; and a first optical element, wherein the first optical element includes a first optical surface that reflects the first light; and a lens surface that projects illuminating light including the first light reflected by the first optical surface, an edge part of the first optical surface close to the lens surface includes a first edge part and a second edge part differing from each other in a position in a direction orthogonal to an optical axis of the lens surface, a position of the second edge part in a direction of the optical axis is closer to the lens surface than a position of the first edge part in the direction of the optical axis wherein the edge part of the first optical surface close to the lens surface further includes a third edge part connecting the first edge part and the second edge part, and on a plane including the first edge part, the third edge part and the second edge part, the edge part of the first optical surface close to the lens surface has a bent line shape in which the third edge part is bent with respect to the first edge part and the second edge part is bent with respect to the third edge part; and wherein a shape of a cutoff line of the light distribution pattern of the illuminating light is a shape corresponding to a shape of the edge part of the first optical surface close to the lens surface.

2. The headlight module according to claim 1, wherein each of the first edge part, the second edge part and the third edge part is a linear ridge line part, the first edge part and the second edge part are parallel to each other, and the third edge part is inclined with respect to the first edge part and the second edge part.

3. The headlight module according to claim 1, wherein an inclination angle of the first optical surface with respect to the optical axis is less than 45 degrees.

4. The headlight module according to claim 1, wherein an inclination angle of the first optical surface with respect to the optical axis is less than or equal to 30 degrees.

5. The headlight module according to claim 1, wherein a region on the first optical surface between an edge part farthest from the lens surface and the first edge part is a plane or curved surface having no step.

6. The headlight module according to claim 1, wherein a region on the first optical surface between an edge part farthest from the lens surface and the second edge part is a plane or curved surface having no step.

7. The headlight module according to claim 5, wherein the region on the first optical surface between the edge part farthest from the lens surface and the second edge part includes a first region on a side of the edge part farthest from the lens surface and a second region on the second edge part's side, and an inclination angle of the second region with respect to the optical axis is smaller than an inclination angle of the first region with respect to the optical axis.

8. The headlight module according to claim 1, wherein the lens surface projects the illuminating light in a light distribution pattern including a shape of the edge part of the first optical surface close to the lens surface.

9. The headlight module according to claim 1, wherein the lens surface projects the illuminating light in a light distribution pattern including a shape of the first light on a conjugate surface including a focal point of the lens surface.

10. The headlight module according to claim 1, wherein a focal point of the lens surface is situated within ±1 mm of the second edge part.

11. The headlight module according to claim 1, wherein the first optical element is an optical element including the lens surface.

12. The headlight module according to claim 1, wherein the first optical element is an optical element including the first optical surface and the lens surface.

13. The headlight module according to claim 12, wherein the first optical element further includes an incidence surface allowing light to pass through and including the edge part of the first optical surface close to the lens surface.

14. The headlight module according to claim 13, further comprising a second light source that emits second light, wherein the first optical element projects the illuminating light including the second light entering the first optical element through the incidence surface.

15. The headlight module according to claim 1, further comprising a second optical element that condenses the first light emitted from the first light source, wherein the first light incident on the first optical surface is the first light condensed by the second optical element.

16. The headlight module according to claim 15, wherein the second optical element is a condensing optical element.

17. The headlight module according to claim 1, further comprising:

a second light source that emits second light; and a third light source that emits third light, wherein the first light, the second light and the third light are incident on the first optical surface in directions different from each other.

18. A headlight device comprising one or more modules, wherein each of the one or more modules is the headlight module according to claim 1.

* * * * *